US011486193B2

(12) United States Patent
Chiang Huang

(10) Patent No.: US 11,486,193 B2
(45) Date of Patent: Nov. 1, 2022

(54) SOLAR ADJUSTMENT APPARATUS AND METHOD OF OPERATING THE SAME

(71) Applicant: SAN HSIN PLASTECH CO., LTD., Taoyuan (TW)

(72) Inventor: Shu-Yuan Chiang Huang, Taoyuan (TW)

(73) Assignee: SAN HSIN PLASTECH CO., LTD., Taoyuan (TW)

( * ) Notice: Subject to any disclaimer, the term of this patent is extended or adjusted under 35 U.S.C. 154(b) by 216 days.

(21) Appl. No.: 16/863,554

(22) Filed: Apr. 30, 2020

(65) Prior Publication Data

US 2021/0340812 A1 Nov. 4, 2021

(51) Int. Cl.

| | |
|---|---|
| ***E06B 9/322*** | (2006.01) |
| *E06B 9/24* | (2006.01) |
| *E06B 9/262* | (2006.01) |
| *E06B 9/68* | (2006.01) |

(52) U.S. Cl.

CPC ..... *E06B 9/322* (2013.01); *E06B 9/262* (2013.01); *E06B 9/68* (2013.01); *E06B 2009/2441* (2013.01); *E06B 2009/2476* (2013.01); *E06B 2009/2627* (2013.01)

(58) Field of Classification Search

CPC ..... E06B 2009/2441; E06B 2009/6818; E06B 2009/6827; E06B 2009/6809; E06B 2009/2627; E06B 2009/2476; E06B 9/68; E06B 9/322; E06B 9/262

See application file for complete search history.

(56) References Cited

U.S. PATENT DOCUMENTS

| | | | | |
|---|---|---|---|---|
| 5,225,748 A * | 7/1993 | Haring | E06B 9/32 | 49/31 |
| 5,848,634 A * | 12/1998 | Will | G05B 19/0426 | 160/310 |
| 6,215,265 B1 * | 4/2001 | Wolfer | H02H 7/0851 | 318/434 |
| 7,418,313 B2 * | 8/2008 | Devis | E06B 9/68 | 700/286 |
| 7,923,948 B2 * | 4/2011 | Rodas | E06B 9/322 | 318/266 |

(Continued)

FOREIGN PATENT DOCUMENTS

| | | |
|---|---|---|
| CN | 203776632 U | 8/2014 |
| CN | 106401440 A | 2/2017 |

OTHER PUBLICATIONS

Office Action dated Jul. 29, 2022 of the corresponding China patent application No. 202010279832.7.

*Primary Examiner* — Johnnie A. Shablack

(74) *Attorney, Agent, or Firm* — Chun-Ming Shih; HDLS IPR Services

(57) ABSTRACT

A solar adjustment apparatus includes a control circuit, two optical encoders, two driving modules, and a power circuit. The control circuit is arranged in an upper rail, and the upper rail is fixed on the upper side of a door or window of a building or vehicle. The two driving modules pivot two spools at the same speed. One of the driving modules controls a height of a middle rail in vertical direction of the door or window through one of optical encoders and one of spools. The other driving module controls a height of a lower rail in vertical direction of the door or window through the other optical encoder and the other spool.

13 Claims, 19 Drawing Sheets

(56) References Cited

U.S. PATENT DOCUMENTS 7,941,245 B1 * 5/2011 Popat ..... E06B 9/68 340/545.8
8,065,039 B2 * 11/2011 Mullet ..... E06B 9/68 700/13
8,830,058 B2 * 9/2014 Yeh ..... E06B 9/322 160/310
8,950,461 B2 * 2/2015 Adams ..... E06B 9/68 160/1
8,981,681 B2 * 3/2015 Malekpour ..... H01R 39/64 318/40
9,018,868 B2 * 4/2015 Lucas ..... E06B 9/42 318/260
9,070,280 B2 * 6/2015 Baker ..... G08C 17/02
9,194,179 B2 * 11/2015 Mullet ..... E06B 9/44
9,267,327 B2 * 2/2016 Feldstein ..... G05B 11/01
9,371,687 B2 * 6/2016 Yu ..... E06B 9/262
9,453,370 B2 * 9/2016 Bohlen ..... E06B 9/88
9,657,516 B2 * 5/2017 Graybar ..... F16H 57/082
9,765,565 B2 * 9/2017 Morris ..... E06B 9/262
9,879,475 B2 * 1/2018 Mullet ..... G05B 19/042
10,072,458 B2 * 9/2018 Mullet ..... E06B 9/368
10,104,997 B2 * 10/2018 Pham ..... H02P 1/16
10,202,801 B2 * 2/2019 Feldstein ..... H02J 7/0003
10,253,561 B2 * 4/2019 Teuscher ..... E06B 9/364
10,538,965 B1 * 1/2020 Nguyen ..... F21V 33/006
10,577,858 B2 * 3/2020 Mullet ..... E06B 9/322
10,655,386 B2 * 5/2020 Adams ..... H04W 52/0277
10,655,387 B2 * 5/2020 Perache ..... E06B 9/68
10,863,846 B2 * 12/2020 Pham ..... E06B 9/326
10,871,029 B2 * 12/2020 Ter Haar ..... E06B 9/325
10,934,774 B2 * 3/2021 Campagna ..... E06B 9/42
11,035,172 B2 * 6/2021 Rieper ..... E06B 9/32
11,268,322 B2 * 3/2022 Campagna ..... E06B 9/72
11,293,222 B2 * 4/2022 Geiger ..... E06B 9/72
2005/0051281 A1 * 3/2005 Lai ..... E06B 9/322 160/167 R
2006/0048904 A1 * 3/2006 Gruner ..... E06B 9/262 160/84.05
2011/0223862 A1 * 9/2011 Satoh ..... H03J 9/02 455/41.2
2013/0020969 A1 * 1/2013 Leivenzon ..... E06B 9/68 318/16
2014/0376747 A1 * 12/2014 Mullet ..... H05B 47/155 381/110
2016/0130867 A1 * 5/2016 Cheng ..... E06B 9/262 160/181
2017/0081912 A1 * 3/2017 Guillory ..... E06B 9/368
2021/0017812 A1 * 1/2021 Cheng ..... E06B 9/322
2021/0189798 A1 * 6/2021 Nien ..... E06B 9/38
2021/0238920 A1 * 8/2021 Zhang ..... H02P 23/18
2021/0340812 A1 * 11/2021 Chiang Huang ..... E06B 9/322
2022/0085738 A1 * 3/2022 Nien ..... E06B 9/262

* cited by examiner

SOLAR ADJUSTMENT APPARATUS AND METHOD OF OPERATING THE SAME

BACKGROUND

Technical Field

A solar adjustment apparatus and a method of electronically operating the same for buildings and vehicles.

Description of Related Art

The statements in this section merely provide background information related to the present disclosure and do not necessarily constitute prior art.

As our society advanced and our economy improved, the indoor living requires more than just sheltering from severe weather but more on customizing the interior comfort and convenience.

Taking indoor lighting as an example, it is usually one of the important factors that affect the indoor environment and atmosphere. Solar intensity is different at different time of the day with different angles. Excessive sun light is discomfort, especially in certain part of the rooms when direct exposure to the sun during the day. Privacy is another issue if the house openings are not covered. Therefore, most buildings or vehicles will mount shades such as curtains, to avoid from directly seeing on the doors and windows. Since sun is moving constantly, the angle of light path to each point of space is changing as well. In addition to unpredictable weather, the requirement of different degrees of shading has evolved during the time. First, the single layer and lateral slide-type operating curtain is invented. Later, double-layered curtains with different light transmitting fabrics which provide more choices of adjusting light into rooms are also created.

The movement of sun on the meridian is almost vertical to earth surface. The angle of light is changing during the day and each day is different. For interior light adjustment, it is difficult to adjusted according to the angle of sun light entering the room because movement of lateral curtain is horizontal adjusted. Traditionally, multi-curtain system with vertical movement will cause various issues such as components of curtains bump into each other, string tangles and curtain twisted. This will not only reduce durability and life span of curtains but also cause maintenance and operation issues.

Designing a solar adjustment apparatus and operating method to resolve above mentioned issues is the main subjects for the inventor of the present disclosure.

SUMMARY

One of the purposes of the present disclosure is to provide a solar adjustment apparatus that can solve the technical problems of difficult to follow relative position of the sun and the earth to make accurate adjustments for light, and can avoid the problems such as components of multiple curtains easily collide with each other, entangle with each other, or deform and twist. Therefore, the curtains can be accurately controlled, and the lifespan and durability can be improved, to achieve the purpose of easy to operate and maintain for users.

The solar adjustment apparatus of the present disclosure includes a control circuit, two optical encoders, two driving modules, and a power circuit. The control circuit is arranged in an upper rail, and the upper rail is fixed on an upper side of a door or window of a building or vehicle. Both optical encoders and two driving modules are arranged in the upper rail and coupled to the control circuit. These two driving modules pivot two spools at the same speed. One of the two driving modules controls a height of a middle rail in vertical direction of the door or window by one of the two optical encoders and one of the two spools. The other one of the two driving modules controls a height of a lower rail in vertical direction of the door or window by the other one of the two optical encoders and the other one of the two spools. The power circuit is coupled to the control circuit and provides electricity to the two driving modules and the two optical encoders.

Each of the two optical encoders is a photo interrupter, the photo interrupter includes a light shielding disc pivoted with one of the two spools, the light shielding disc includes 32 inner perforations with equal intervals in a circle, the two driving modules are arranged in parallel on one side of the control circuit, and the two driving modules are arranged on different planes perpendicular to the ground.

Further, each of the two driving modules includes a Hall sensor, a brushless DC motor, and a deceleration box, the Hall sensor is coupled to the control circuit and the brushless DC motor, the brushless DC motor is pivotally coupled to the deceleration box and one of the two optical encoders.

Further, a shielding curtain is arranged between the upper rail and the middle rail, and one of the two driving modules controls the middle rail to control a shielding area formed by the shielding curtain on the door or window.

Further, a shielding curtain is arranged between the middle rail and the lower rail, and one of the two driving modules controls the lower rail to control a shielding area formed by the shielding curtain on the door and window.

Further, a first shielding curtain is arranged between the upper rail and the middle rail, a second shielding curtain is arranged between the middle rail and the lower rail, one of the two driving modules controls the middle rail to control a shielding area formed by the first shielding curtain on the door and window, the other one of the two driving modules controls the lower rail to control a shielding area formed by the second shielding curtain on the door and window.

Further, the upper rail is fixed on the upper side of the door or window by a plurality of locking members, the two spools are arranged in parallel in a spool box, and the two spools are arranged on different planes perpendicular to the ground.

Further, the two spools are arranged in parallel in the spool box, and the two spools are arranged on same plane parallel to the ground, the two driving modules are on the same plane parallel to the ground.

Further, the power circuit includes a mains module or a renewable energy module, the renewable energy module includes a solar cell and a secondary battery, the secondary battery receives an electrical energy through the solar cell, and outputs the electrical energy to the control circuit, and the two driving modules.

Further, the light shielding disc further includes 16 outer perforations with unequal intervals in another circle, and the 16 outer perforations surrounding outside of the 32 inner perforations.

Further, the solar adjustment apparatus includes a remote controller and a wireless port is coupled to the control circuit, the remote controller inputs a control command to the control circuit through the wireless port, the control circuit controls at least one of the two driving modules according to the control command.

Further, the solar adjustment apparatus further includes a physical control key set, a wired port, and a buzzer, the physical control key set is coupled to the control circuit, the physical control key set including a pairing key and a plurality of control keys, after the pairing key outputs a pairing command to the control circuit, the control circuit performs a wireless spectrum pairing process with the remote controller according to the pairing command within a specific time, the plurality of control keys outputs a plurality of the control commands, the wired port being a hardware port compatible with RS-485 communication protocol and Modbus standard packets, and the wired port inputs an external command to the control circuit.

The other one of the purposes of the present disclosure is to provide an operating method of a solar adjustment apparatus that can solve the technical problems of difficult to follow relative position of the sun and the earth to make accurate adjustments for light, and can avoid the problems such as components of multiple curtains easily collide with each other, entangle with each other, or deform and twist. Therefore, the curtains can be accurately controlled, and the life and durability can be improved, to achieve the purpose of easy to operate and maintain for users.

In order to achieve the other one of the purposes, an upper rail of the solar adjustment apparatus of the present disclosure is fixed on an upper side of a door or window of a building or vehicle, a middle rail and a lower rail are sequentially arranged below the upper rail and moving in vertical direction, the operating method includes steps of: When a control circuit of the solar adjustment apparatus receives an initial position setting command, a first driving module and a second driving module got into an initial position setting state, during the initial position setting state, the first driving module moves the middle rail to a first initial position according to a short press command or a long press command, the first initial position with a first initial height away from the ground, and the second driving module moves the lower rail to a second initial position according to the short press command or the long press command, the second initial position with a second initial height away from the ground. After confirming the end of the initial position setting state, when the control circuit receives a lower rail lowest limit command, the second driving module got into a lower rail lowest limit setting state, during the lower rail lowest limit setting state, the second driving module moves the lower rail to a lowest limit position of the lower rail according to the short press command or the long press command, and the lowest limit position of the lower rail with a first minimum height from the ground. After confirming the end of the initial position setting state, when the control circuit receives a middle rail lowest limit command, the first driving module got into a middle rail lowest limit setting state, during the middle rail lowest limit setting state, the first driving module moves the middle rail to a lowest limit position of the middle rail according to the short press command or the long press command, and the lowest limit position of the middle rail with a second minimum height from the ground. After confirming the end of the initial position setting state, when the control circuit receives a middle rail highest limit command, the first driving module got into a middle rail highest limit setting state, during the middle rail highest limit setting state, the first driving module moves the middle rail to a highest limit position of the middle rail according to the short press command or the long press command, and the highest limit position of the middle rail with a first maximum height from the ground. After confirming the end of the initial position setting state, when the control circuit receives a lower rail highest limit command, the second driving module got into a lower rail highest limit setting state, during the lower rail highest limit setting state, the second driving module moves the lower rail to a highest limit position of the lower rail according to the short press command or the long press command, and the highest limit position of the lower rail with a second maximum height from the ground. A speed of the middle rail moved by the first driving module is equal to a speed of the lower rail moved by the second driving module, the middle rail moves between the highest limit position of the middle rail and the lowest limit position of the middle rail, the lower rail moves between the highest limit position of the lower rail and the lowest limit position of the lower rail.

Further, the middle rail or the lower rail stops after only one inch shifting according to the short press command, or the middle rail or the lower rail performs a one-way continuous action according to the long press command until the control circuit receives a stop command.

Further, a first shielding curtain is arranged between the upper rail and the middle rail, the first driving module controls the middle rail through a first spool of a spool box and a first lifting string wound on the first spool, the first lifting string is movable through the first shielding curtain, and connected to the middle rail.

Further, a second shielding curtain is arranged between the middle rail and the lower rail, the second driving module controls the lower rail through a second spool of the spool box and a second lifting string wound on the second spool, the second lifting string is movably inserted in the first shielding curtain and the second shielding curtain, and connected to the lower rail.

Further, the solar adjustment apparatus further includes a remote controller and a wireless port coupled to the control circuit, the remote controller inputs the initial position setting command, the lower rail lowest limit command, the middle rail lowest limit command, the middle rail highest limit command, and the lower rail highest limit command to the control circuit through the wireless port.

Further, after confirming the end of the lower rail lowest limit setting state and the end of the middle rail lowest limit setting state, the lower rail and the middle rail got into a first state, a second state, a third state, a fourth state, a fifth state, a sixth state, a seventh state or an eighth state. The first state is that the middle rail goes down and the lower rail goes down in order. The second state is that the middle rail goes up and the lower rail goes up in order. The third state is that the middle rail goes down and the lower rail goes up in order. The fourth state is that the middle rail goes up and the lower rail goes down in order. The fifth state is that the middle rail goes down and the lower rail goes down simultaneously. The sixth state is that the middle rail goes up and the lower rail goes up simultaneously. The seventh state is that the middle rail goes down and the lower rail goes up simultaneously. The eighth state is that the middle rail goes up and the lower rail goes down simultaneously.

Further, the first driving module controls the middle rail by a first optical encoder and one of spools, the second driving module controls the lower rail by a second optical encoder and another one of the spools.

Further, the operating method of the solar adjustment apparatus further includes step of: When the control circuit receives a restore initial setting command, the first driving module moves the middle rail to the first initial position, the second driving module moves the lower rail to the second initial position.

Further, the operating method of the solar adjustment apparatus further includes step of: When the control circuit receives a pairing command, the control circuit performs a wireless spectrum pairing process with a remote controller according to the pairing command within a specific time.

Further, the operating method of the solar adjustment apparatus further includes step of: When the control circuit receives an additional remote controller command, the control circuit performs the wireless spectrum pairing process with another remote controller according to the adding remote controller command within the specific time.

Further, the operating method of the solar adjustment apparatus further includes step of: When the control circuit receives a clear pairing command, the control circuit clears all previous set data of the wireless spectrum pairing process.

Further, the operating method of the solar adjustment apparatus further includes step of: When the control circuit receives a favorite position setting command to move the middle rail or the lower rail to a specific height, the first driving module or the second driving module got into a favorite position setting state, during the favorite position setting state, if the control circuit determines that the specific height different from previous setting, the control circuit completes to configure a favorite position of the middle rail or the lower rail with the specific height, and ended the favorite position setting state, or if the control circuit determines that the specific height as same as the previous setting, the control circuit clears the previous setting, and end the favorite position setting state.

Further, the operating method of the solar adjustment apparatus further includes step of: If the middle rail or the lower rail close to the favorite position, when the control circuit receives a favorite position execution command, the control circuit moves the middle rail or the lower rail to the favorite position. If the middle rail or the lower rail already in the favorite position, and there are a plurality of the favorite locations, when the control circuit receives the favorite position execution command, the control circuit moves the middle rail or the lower rail to another one of the pluralities of the favorite locations. If the middle rail or the lower rail already in the favorite position, and there is only one the favorite location, when the control circuit receives the favorite position execution command, the control circuit stops the middle rail or the lower rail.

When using the solar adjustment apparatus of the present disclosure, the middle rail or the lower rail can be preset with an initial position, a highest limit position and a lowest limit position, so that the middle rail and the lower rail are electrically controlled by the first driving module and the second driving module within a safe range. The first driving module and the second driving module can precisely control the middle rail and the lower rail to reach a precise position under the control of the first optical encoder and the second optical encoder. Further, because of the speed of the middle rail moved by the first driving module is equal to the speed of the lower rail moved by the second driving module, it can avoid the collision between the middle rail and the lower rail when they move in the same or opposite direction, and simultaneously or sequentially.

For this reason, solar adjustment apparatus that can solve the technical problems of difficult to follow relative position of the sun and the earth to make accurate adjustments for light, and can avoid the problems such as components of multiple curtains easily collide with each other, entangle with each other, or deform and twist. Therefore, the curtains can be accurately controlled, and the life and durability can be improved, to achieve the purpose of easy to operate and maintain for users.

In order to further understand the techniques, means, and effects of the present disclosure for achieving the intended purpose. Please refer to the following detailed description and drawings of the present disclosure. The drawings are provided for reference and description only, and are not intended to limit the present disclosure.

DETAILED DESCRIPTION

Figure 1A:
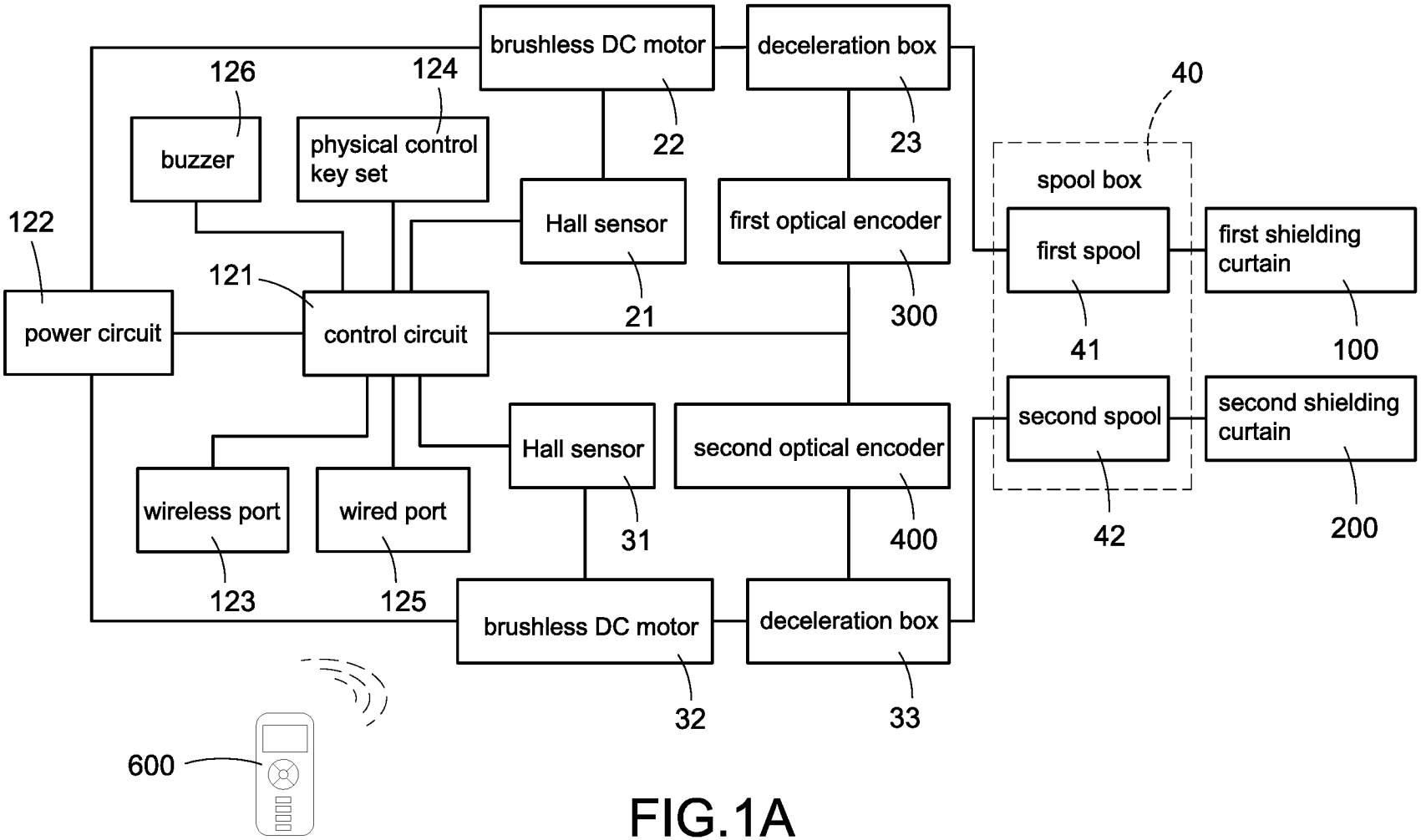
FIG. 1A and FIG. 1B are system architecture diagrams of a solar adjustment apparatus of the present disclosure.

The embodiment of the present disclosure is described by way of specific examples, and those skilled in the art can readily appreciate the other advantages and functions of the present disclosure. The present disclosure may be embodied or applied in various other specific embodiment, and various modifications and changes can be made without departing from the spirit and scope of the present disclosure.

It should be understood that the structures, the proportions, the sizes, the number of components, and the like in the drawings are only used to cope with the contents disclosed in the specification for understanding and reading by those skilled in the art, and it is not intended to limit the conditions that can be implemented in the present disclosure, and thus is not technically significant. Any modification of the structure, the change of the proportional relationship, or the adjustment of the size, should be within the scope of the technical contents disclosed by the present disclosure without affecting the effects and the achievable effects of the present disclosure.

The technical content and detailed description of the present disclosure will be described below in conjunction with the drawings.

Figure 1B:
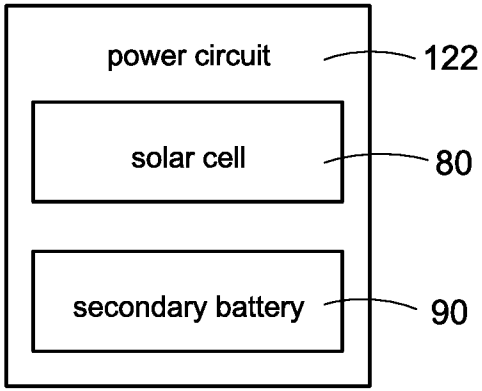
Figure 2:
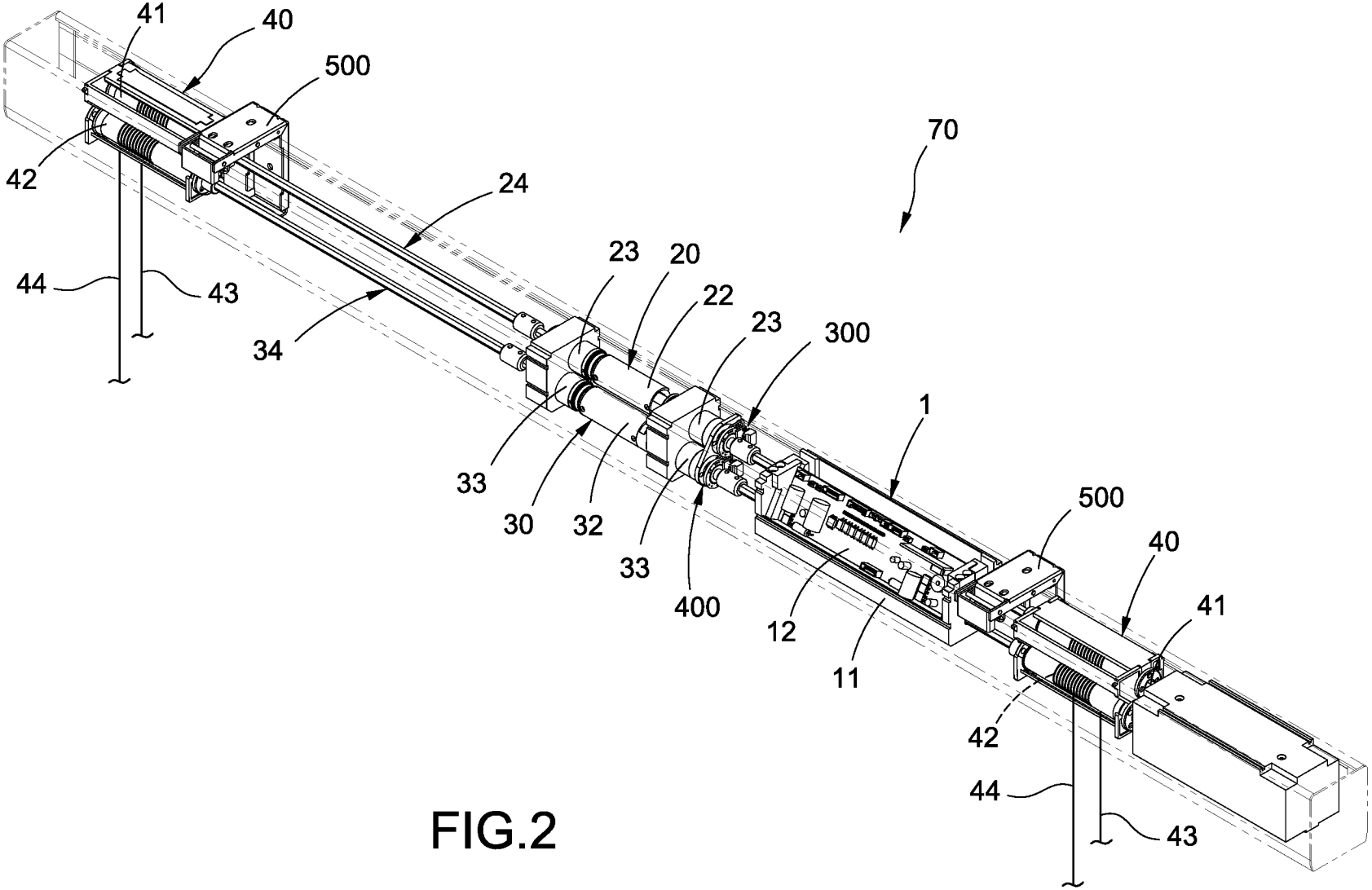
FIG. 2 is a structural diagram of a first embodiment of the solar adjustment apparatus of the present disclosure.
Figure 3A:
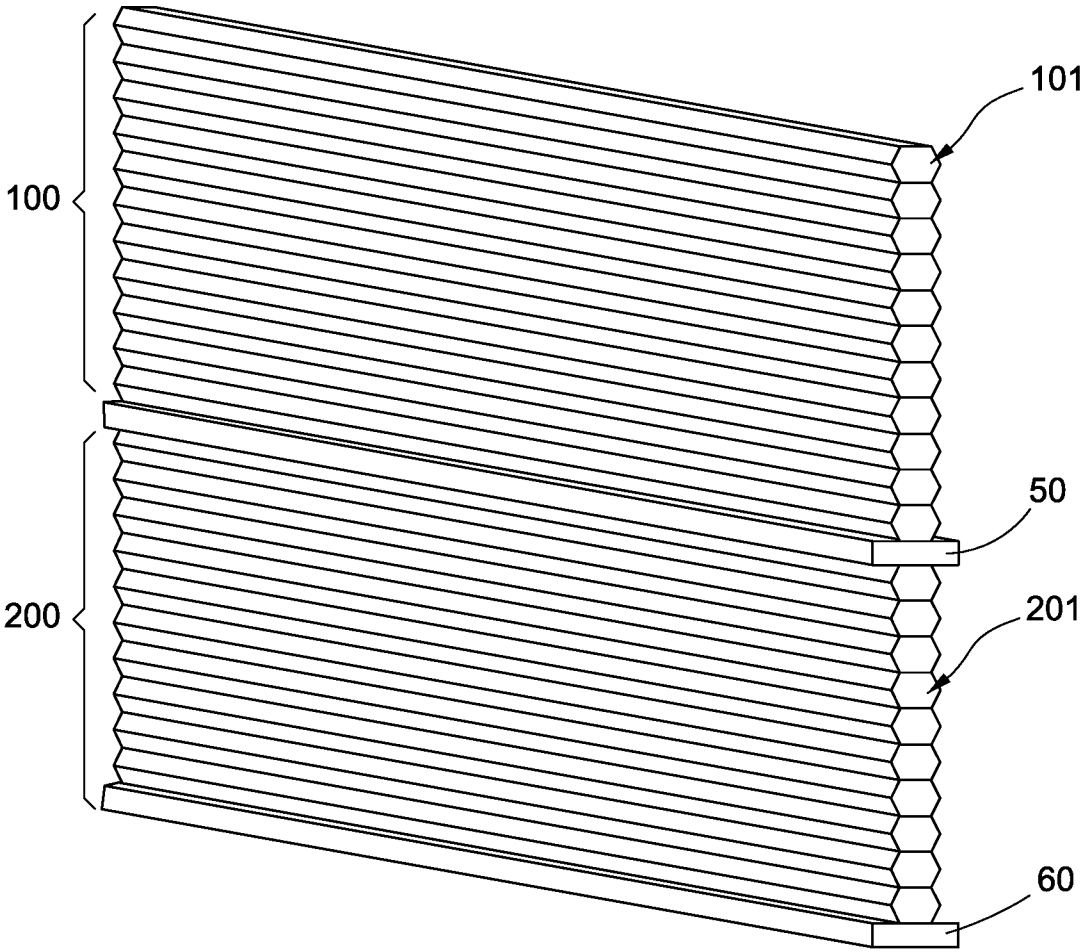
FIG. 3A and FIG. 3B are schematic diagrams of shielding curtains of the solar adjustment apparatus of the present disclosure.
Figure 3B:
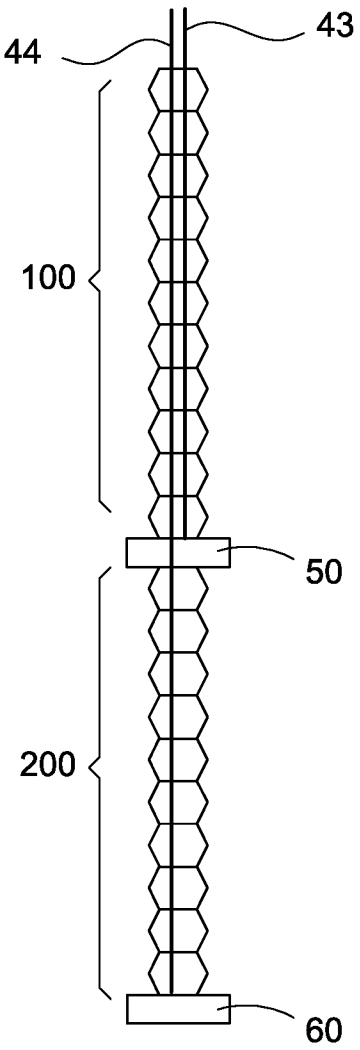
Figure 3C:
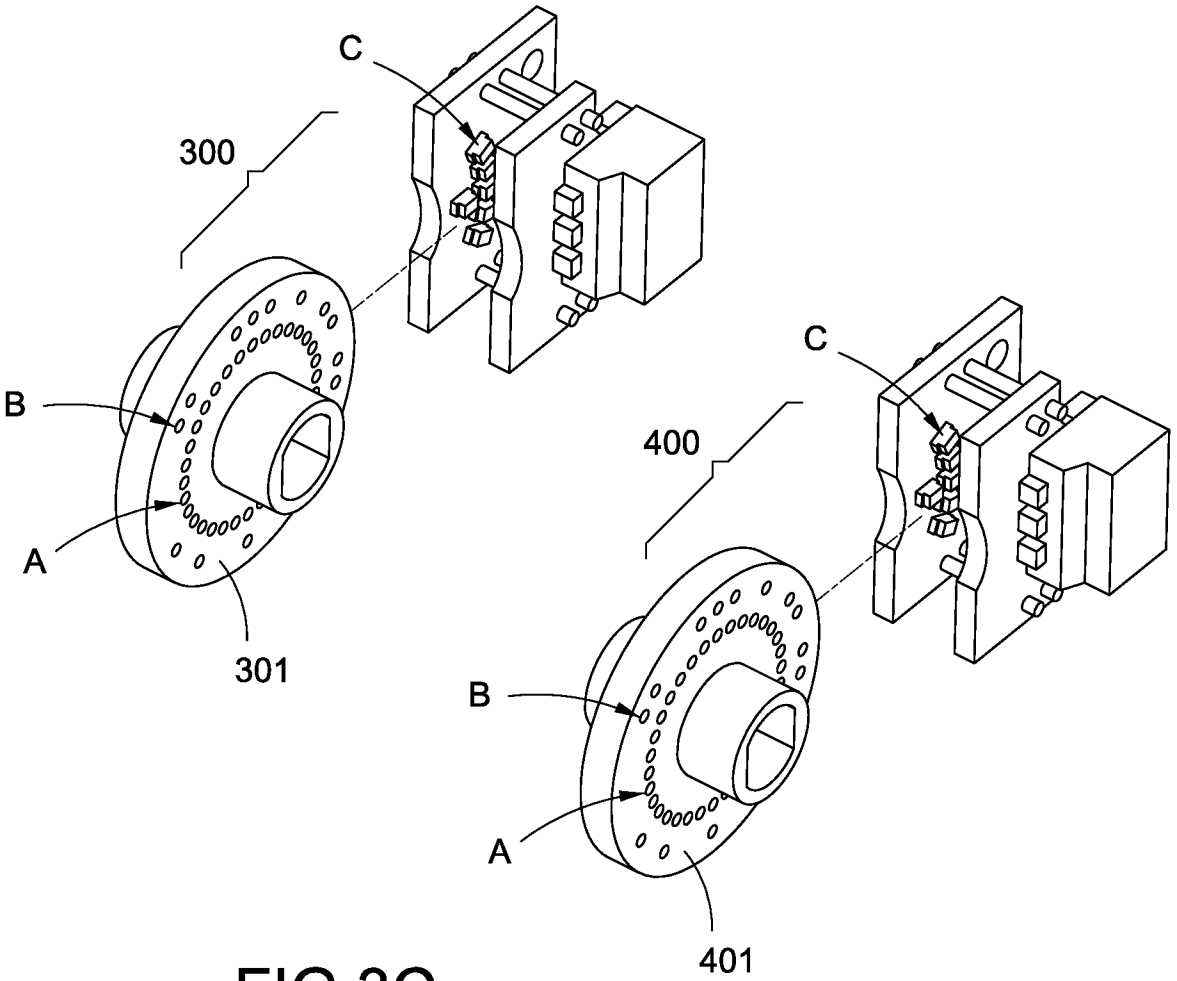
FIG. 3C is a schematic diagram of optical encoders of the adjustment apparatus of the present disclosure.

Please refer to FIG. 1A to FIG. 3C. FIG. 1A and FIG. 1B are system architecture diagrams of a solar adjustment apparatus of the present disclosure. FIG. 2 is a structural diagram of a first embodiment of the solar adjustment apparatus of the present disclosure. FIG. 3A and FIG. 3B are schematic diagrams of shielding curtains of the solar adjustment apparatus of the present disclosure. FIG. 3C is a schematic diagram of optical encoders of the solar adjustment apparatus of the present disclosure.

As shown in FIG. 1A and FIG. 1B, in the first embodiment of the present disclosure, the solar adjustment apparatus is applied to a first shielding curtain 100 and a second shielding curtain 200 arranged in parallel to each other. The bottom of the first shielding curtain 100 is connected to the top of the second shielding curtain 200 (that is, the first shielding curtain 100 and the second shielding curtain 200 are on the same plane). The solar adjustment apparatus includes a control circuit 121, a first driving module 20, a second driving module 30, and a power circuit 122. In an embodiment not shown of the present disclosure, it may be implemented with only the first shielding curtain 100 without the second shielding curtain 200, or may be implemented with only second shielding curtain 200 without the first shielding curtain 100. The first shielding curtain 100 and the second shielding curtain 200 in the first embodiment is only one aspect of the present disclosure, the present disclosure is not limited thereto. The first driving module 20 is coupled to the control circuit 121, and controls a shielding area formed by the first shielding curtain 100 in a building (not shown in the figure) or vehicle (not shown in the figure) through a first optical encoder 300. In the first embodiment of the present disclosure, the first driving module 20 includes a Hall sensor 21 (configured in the first driving module 20), a brushless DC motor (BLDC motor) 22, the deceleration box 23, and a first rotating shaft 24. The Hall sensor 21 is coupled to a control circuit 121. The brushless DC motor 22 is coupled to the deceleration box 23 and the first optical encoder 300 through the first rotating shaft 24 pivotal.

The second driving module 30 is coupled to the control circuit 121, and controls a shielding area formed by the second shielding curtain 200 in a building or vehicle through a second optical encoder 400. The first driving module 20 and the second driving module 30 are arranged in parallel on one side of the control circuit 121, the first driving module 20 and the second driving module 30 are on different planes perpendicular to the ground. In the first embodiment of the present disclosure, the second driving module 30 includes a Hall sensor 31 (configured in the second driving module 30), a BLDC motor 32, a deceleration box 33, and a second rotating shaft 34. The Hall sensor 31 is coupled to the control circuit 121. The BLDC motor 32 is coupled to the deceleration box 33 and the second optical encoder 400 through the second rotating shaft 34 pivotable. In the embodiment of the present disclosure, a speed of a middle rail 50 moved by the first driving module 20 is equal to a speed of a lower rail 60 moved by the second driving module 30. Therefore, the middle rail 50 and the lower rail 60 can ensure that no collision between the middle rail 50 and the lower rail 60 when they move in the same or opposite direction, and simultaneously or sequentially.

The power circuit 122 is coupled to the control circuit 121, and provides electrical energy to the first driving module 20 and the second driving module 30. Further, the control circuit 121 controls the electrical energy outputted by the power circuit 122 to the BLDC motors 22, 32 according to the information of the Hall sensors 21, 31. In the first embodiment of the present disclosure, the power circuit 122 may use a mains module or a renewable energy module. If the power circuit 122 uses a renewable energy module, it may include a solar cell 80 and a secondary battery 90 (as shown in FIG. 1B). The secondary battery 90 (such as a lithium battery) can draw electrical energy through the solar cell 80, and output the electrical energy to the control circuit 121, the first driving module 20 and the second driving module 30. The solar cell 80 may choose to use mono-crystalline silicon, poly-crystalline silicon, amorphous silicon, dye-sensitized material, or other group III-V semiconductor materials according to the position of the solar adjustment apparatus in the building or vehicle. For example, may use mono-crystalline silicon or group III-V semiconductor materials that with large energy gap in areas with high light intensity, or may use amorphous silicon that with small energy gap in areas with low light intensity. However, the present disclosure is not limited thereto.

In the first embodiment of the present disclosure, the control circuit 121, the first driving module 20, the second driving module 30, and the power circuit 122 are all accommodated in an upper rail 70. The upper rail 70 can be fixed on an upper side of the door or window of the building or vehicle by a plurality of locking members 500, as shown in FIG. 2.

In the first embodiment of the present disclosure, the solar adjustment apparatus further includes a remote controller 600, a wireless port 123 coupled to the control circuit 121, a physical control key set 124, a wired port 125, and a buzzer 126. The remote controller 600 inputs a control command (not shown) to the control circuit 121 through the wireless port 123, so that the control circuit 121 controls at least one of the first driving module 20 and the second driving module 30 according to the control command. The wireless port 123 is compatible with RF, Wi-Fi 2.4G, Wi-Fi 5G, NFC, Bluetooth, Zigbee, IR and other communication protocols. The physical control key set 124 may include a pairing key (not shown in the figure) and a plurality of control keys (not shown in the figure). After the pairing key outputs a pairing command to the control circuit 121, the control circuit 121 may perform a wireless spectrum pairing process with the remote controller 600 according to the pairing command within a specific time. The plurality of control keys output a plurality of control commands to the control circuit 121 to control at least one of the first driving module 20 and the second driving module 30 according to the control commands. The wired port 125 may be a hardware port compatible with RS-485 communication protocol. The RS485 of the present disclosure is compatible with Modbus standard packets, and is used to input an external command to the control circuit 121. The buzzer 126 can be used for the control circuit 121 to broadcast a sound when receiving any command.

As shown in FIG. 3A and FIG. 3B. The first shielding curtain 100 has a first light transmittance by its material composition and a plurality of first air chambers 101 foldable. The second shielding curtain 200 has a second light transmittance different from the first light transmittance and a plurality of second air chambers 201 foldable. Further, referring to FIG. 2 to FIG. 3B, the cross sections of the first air chamber 101 and the second air chamber 201 may be honeycomb shapes, regular hexagons, or another variant such as single layer honeycombs and double-layer honeycombs. However, the fabric for making the first shielding curtain 100 or the second shielding curtain 200 is not limited to a honeycomb shape, as long as it can be folded and stored (e.g., folding curtain, Roman curtain). However, the present disclosure is not limited thereto. The first air chamber 101 and the second air chamber 201 can be configured with single-layer or multi-layer dissimilar materials according to special requirements (such as reducing ultra-violet (UV) rays, reducing infrared (IR) rays, isolating full spectrum, nano size of silver ion for antibacterial, photo-catalytic for decomposition of formaldehyde, etc.). A middle rail 50 is interposed between the first shielding curtain 100 and the second shielding curtain 200. The first driving module 20 controls the first shielding curtain 100 through a first spool 41 of a spool box 40 and a first lifting string 43 wound on the first spool 41. That is, the first driving module 20 controls the first shielding curtain 100 by controlling the middle rail 50. The first lifting string 43 is movably installed in the first shielding curtain 100, and connected to the middle rail 50. The bottom of the second shielding curtain 200 is provided with the lower rail 60. The second driving module 30 controls the second shielding curtain 200 through a second spool 42 of the spool box 40 and a second lifting string 44 wound on the second spool 42. That is, the second driving module 30 controls the second shielding curtain 200 by controlling the lower rail 60. The second lifting string 44 is movably inserted in the first shielding curtain 100 and the second shielding curtain 200, and connected to the lower rail 60.

As shown in FIG. 2, in the first embodiment of the present disclosure, the control circuit 121 can be configured on a circuit board 12, and the circuit board 12 is covered by a first housing 11 to form a circuit module 1. The first spool 41 and the second spool 42 are arranged in parallel in the spool box 40, and the first spool 41 and the second spool 42 are arranged on different planes perpendicular to the ground, which can avoid the first lifting string 43 and the second lifting string 44 interfere with each other, or even cause a dangerous situation. In the first embodiment of the present disclosure, there are two spool boxes 40, and the two spool boxes 40 are respectively arranged on opposite sides of the circuit module 1. The inclination angle of the circuit board 12 corresponding to the ground is matched to the relative positions of the first driving module 20 and the second driving module 30, the relative positions of the first spool 41 and the second spool 42, and the relative position of the first optical encoder 300 and the second optical encoder 400.

As shown in FIG. 3C, the first optical encoder 300 and the second optical encoder 400 are both photo interrupters, which is a rotary type encoder. The first optical encoder 300 includes a light shielding disc 301 pivoted with the first spool 41, and the light shielding disc 301 includes 32 inner perforations A with equal intervals in a circle. The second optical encoder 400 includes a light shielding disc 401 pivoted with the second spool 42, and the light shielding disc 401 includes 32 inner perforations A with equal intervals in a circle. Further, the light shielding discs 301, 401 are further includes 16 outer perforations B with unequal intervals in another circles, and the 16 outer perforations B surrounding outside of the 32 inner perforations A. Further, the first optical encoder 300 and the second optical encoder 400 are detected by the light shielding discs 301, 401 and the six light-emitting units C respectively, and the control circuit 121 can accurately control the output of the first driving module 20 and the second driving module 30 by the inner perforations A and the outer perforations B on the light shielding discs 301, 401. Afterward, The control circuit 121 can accurately control the positions of the middle rail 50 and the lower rail 60 by the first driving module 20 and the second driving module 30, and used with the first driving module 20 and the second driving module 30 that have the same speed can further prevent the collision between the middle rail 50 and the lower rail 60.

The first optical encoder 300 is arranged on one side of the first driving module 20 and is adjacent to the deceleration box 23. The second optical encoder 400 is arranged on one side of the second driving module 30 and adjacent to the deceleration box 33. The first optical encoder 300 and the second optical encoder 400 are on the same plane perpendicular to the ground.

Figure 4:
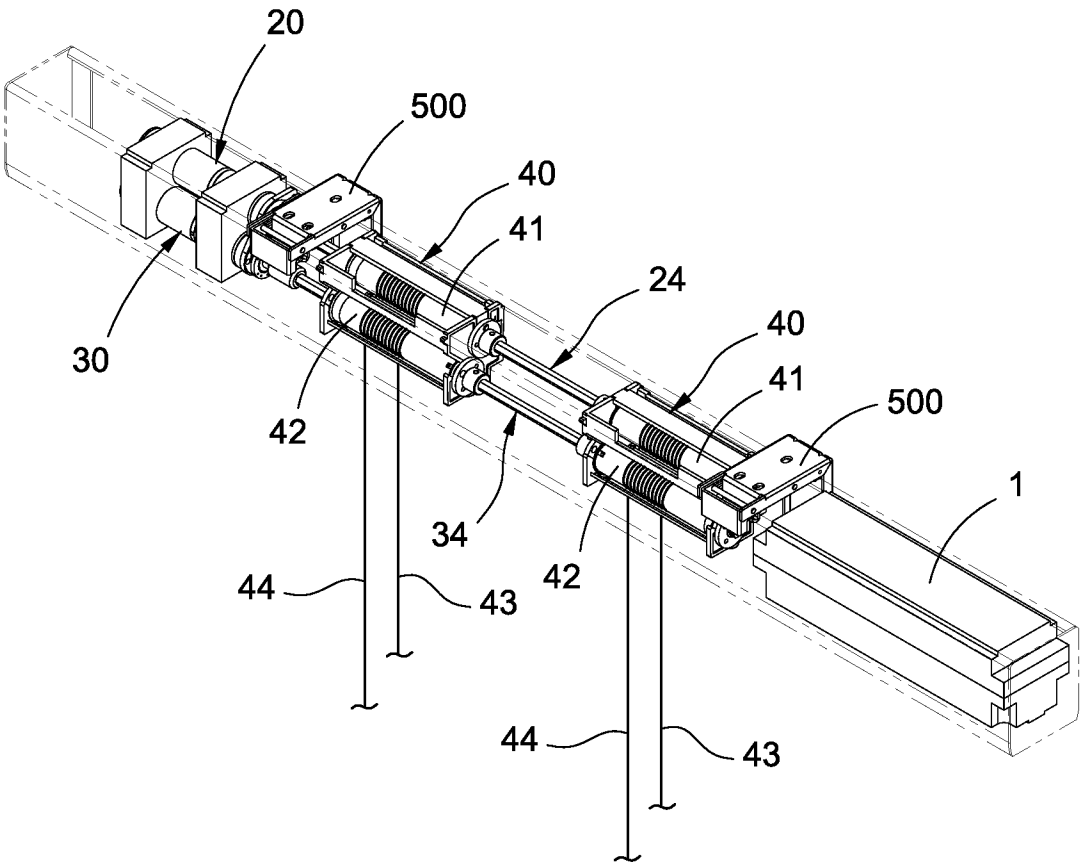
FIG. 4 is a structural diagram of a second embodiment of the solar adjustment apparatus of the present disclosure.

Please refer to FIG. 4, the FIG. 4 is a structural diagram of a second embodiment of the solar adjustment apparatus of the present disclosure. The second embodiment of the present disclosure is substantially the same as the first embodiment described above, except that two spool boxes 40 are both arranged on same side of the circuit module 1, and the positions of the two spool boxes 40 are located between the circuit module 1 and the driving assembly that includes the first driving module 20 and the second driving module 30.

Figure 5:
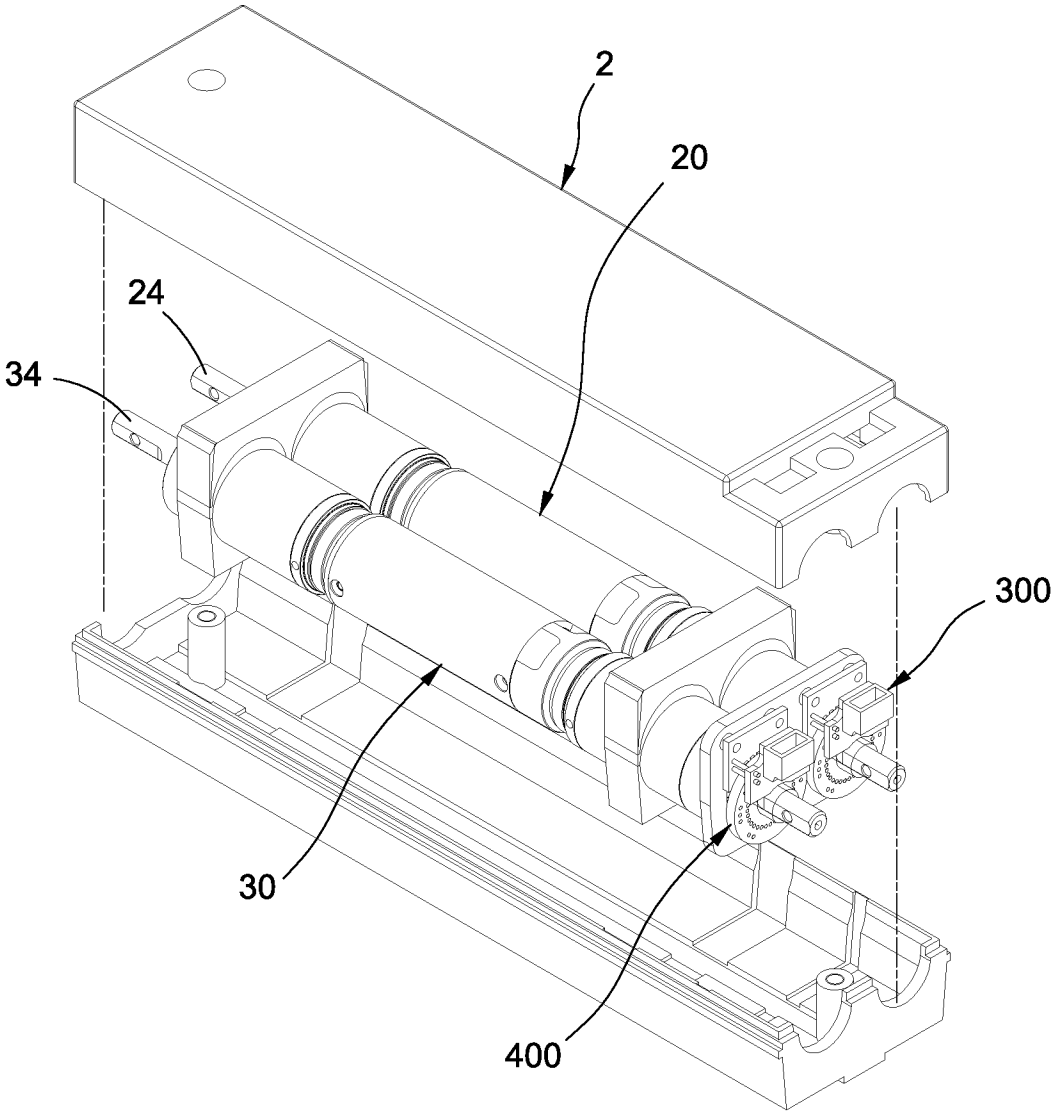
FIG. 5 is a structural diagram of a driving assembly of a third embodiment of the solar adjustment apparatus of the present disclosure.
Figure 6:
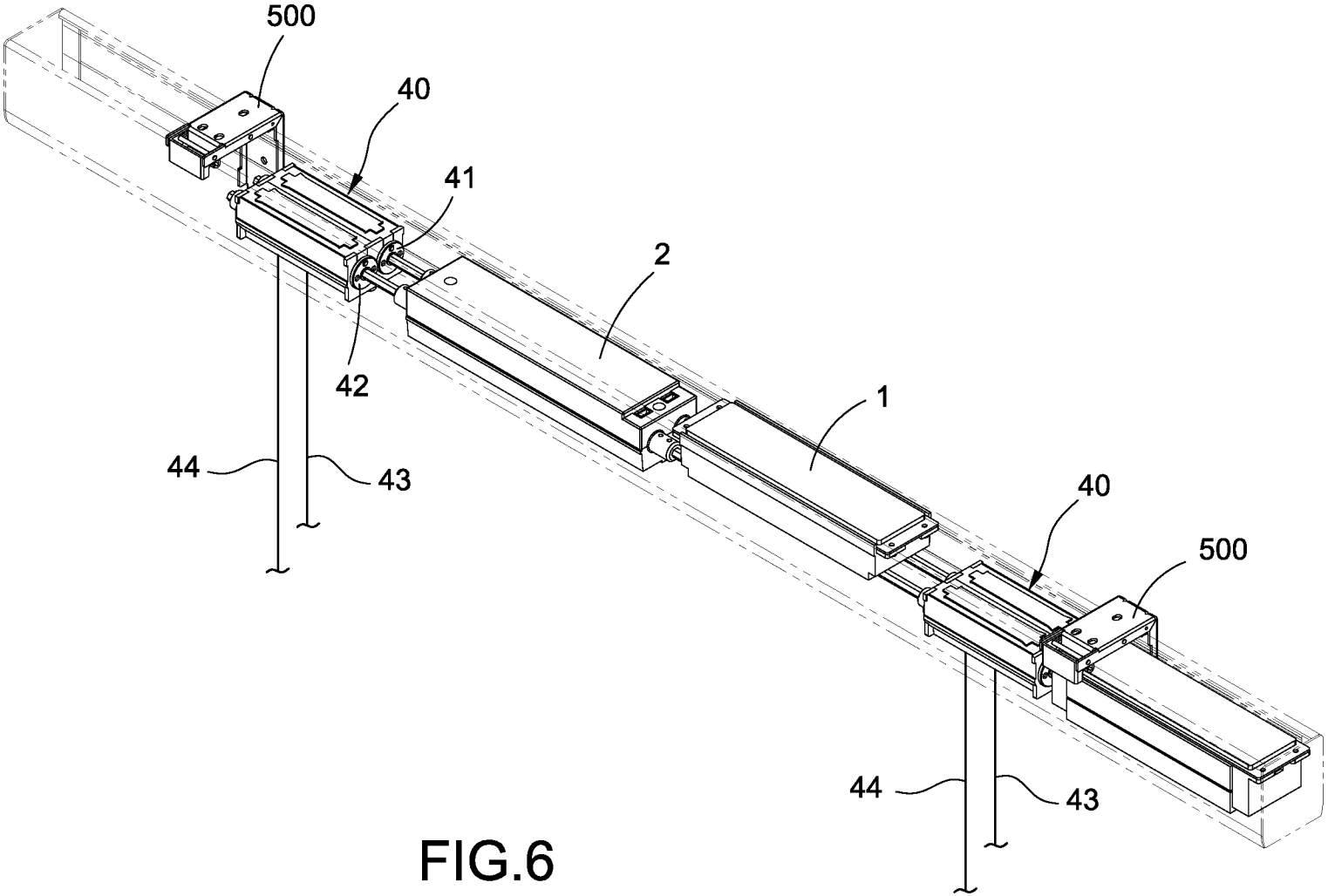
FIG. 6 is a structural diagram of the third embodiment of the solar adjustment apparatus of the present disclosure.

Please refer to FIG. 5 and FIG. 6. The FIG. 5 is a structural diagram of a driving assembly of a third embodiment of the solar adjustment apparatus of the present disclosure. The FIG. 6 is a structural diagram of the third embodiment of the solar adjustment apparatus of the present disclosure.

The third embodiment of the present disclosure is substantially the same as the first embodiment described above, except that the first driving module 20 and the second driving module 30 are on the same plane parallel to the ground, the first spool 41 and the second spool 42 are on the same plane parallel to the ground, and the two spool boxes 40 both are arranged on same side of the circuit module 1. Further, the first driving module 20 and the second driving module 30 are sandwiched in a second housing 2 to form the driving assembly, and only a first rotating shaft 24 and a second rotating shaft 34 are pivotably protrude beyond the second housing 2.

Figure 7:
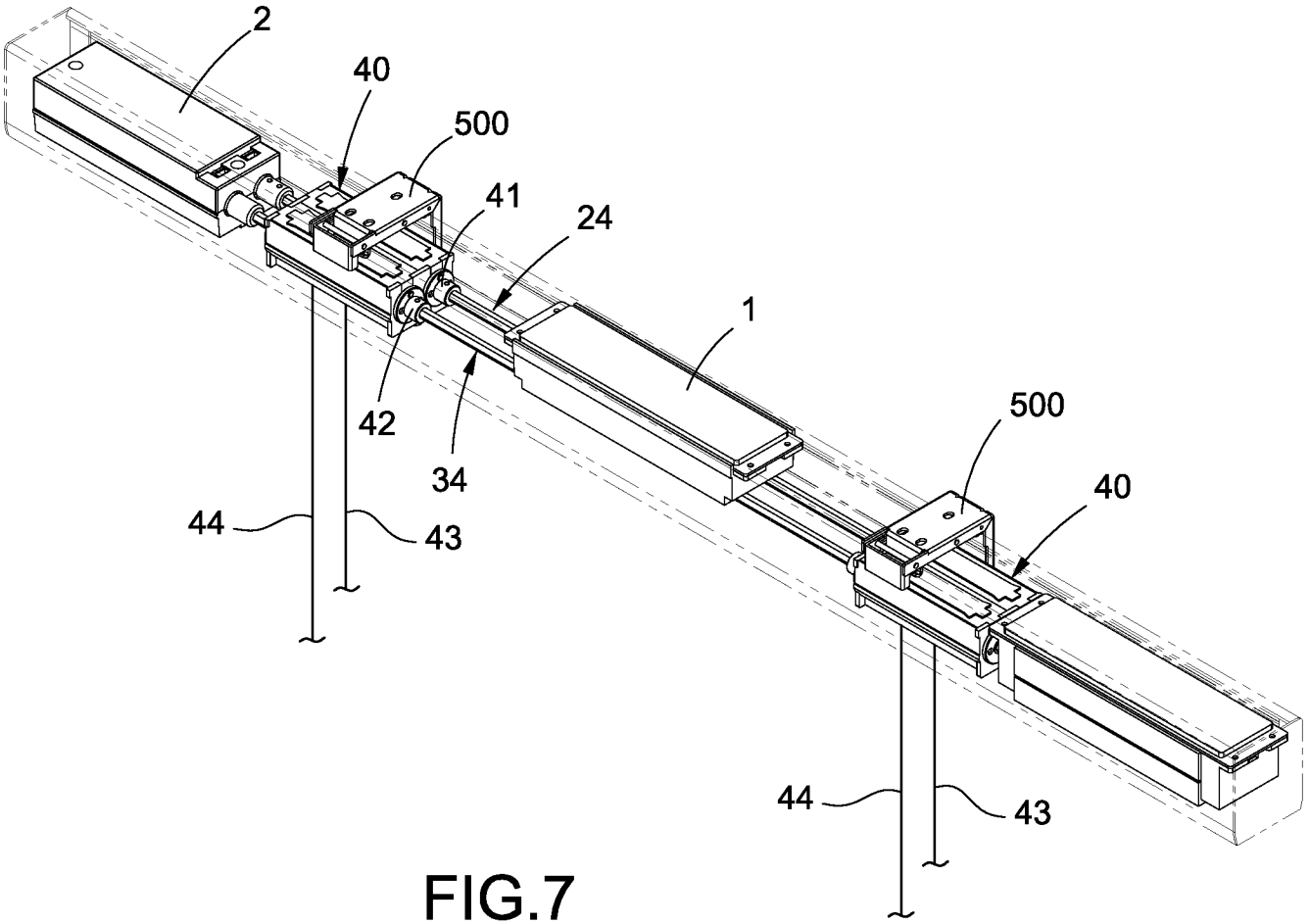
FIG. 7 is a structural diagram of a fourth embodiment of the solar adjustment apparatus of the present disclosure.

Please refer to FIG. 7. The FIG. 7 is a structural diagram of a fourth embodiment of the solar adjustment apparatus of the present disclosure. The fourth embodiment of the present disclosure is substantially the same as the third embodiment described above, except that the two spool boxes 40 are arranged between the circuit module 1 and the second housing 2 interposed with the first driving module 20 and the second driving module 30.

Figure 8:
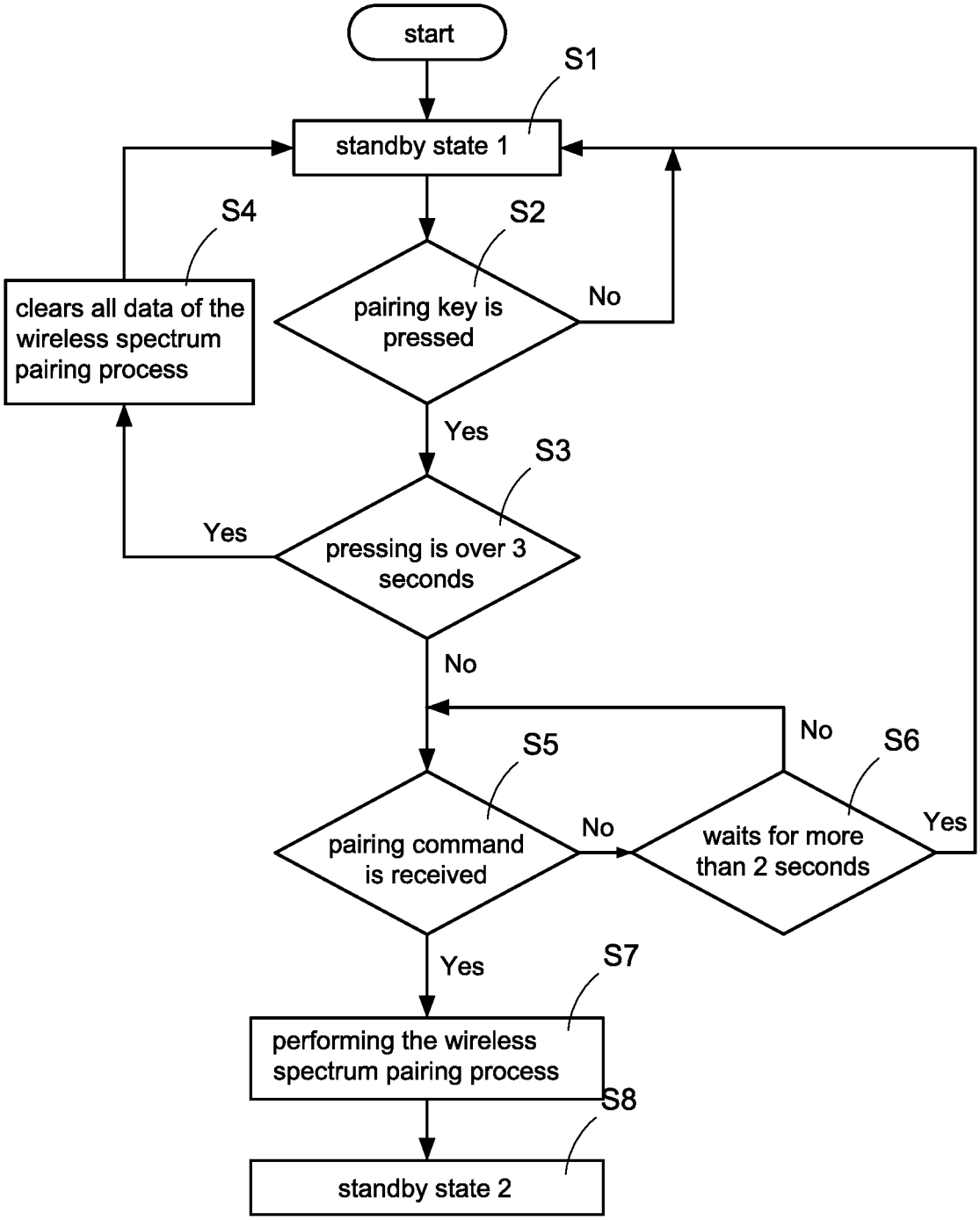
FIG. 8 to FIG. 16 are flowcharts of an operation method of the solar adjustment apparatus of the present disclosure.

FIG. 8 to FIG. 16 are flowcharts of an operation method of the solar adjustment apparatus of the present disclosure. As shown in FIG. 8, when operating the solar adjustment apparatus according to the present disclosure, it is necessary to pair the wireless port 123 of the control circuit 121 and the remote controller 600 at the beginning, so that the remote controller 600 can input an initial position setting command, a lower rail lowest limit command, a middle rail lowest limit command, a middle rail highest limit command, a lower rail highest limit command, a short press command, or a long press command to the control circuit 121 through the wireless port 123. In a standby state 1 (step S1), when it is confirmed that the pairing key is pressed (step S2), and then it is determined whether the pressing is over 3 seconds (step S3), and if the pressing exceeds 3 seconds, the control circuit clears all data of the wireless spectrum pairing process (step S4). That is, deleting the data of previous pairing about the remote controller bounded. And then, if it is determined that the pairing command is received (step S5), performing the wireless spectrum pairing process (step S7). That is, the remote controller 600 on site is bound immediately and is gotten into a standby state 2 (step S8). If it is determined that the pairing command is not received and waits for more than 2 seconds (step S6), it returns to the standby state 1 (step S1). In the operation method of the present disclosure, the control circuit 121 of the present disclosure can be coupled to a maximum of 12 remote controllers 600 at the same time. If another remote controller 600 needs to be added, the control circuit 121 can perform the wireless spectrum pairing process with another remote controller 600 according to an adding remote controller command (which can be the same as the pairing command) within the specific time (for example, 2 seconds). Further, when the control circuit 121 receives a clear pairing command, the control circuit 121 clears all data of the wireless spectrum pairing process.

Figure 9:
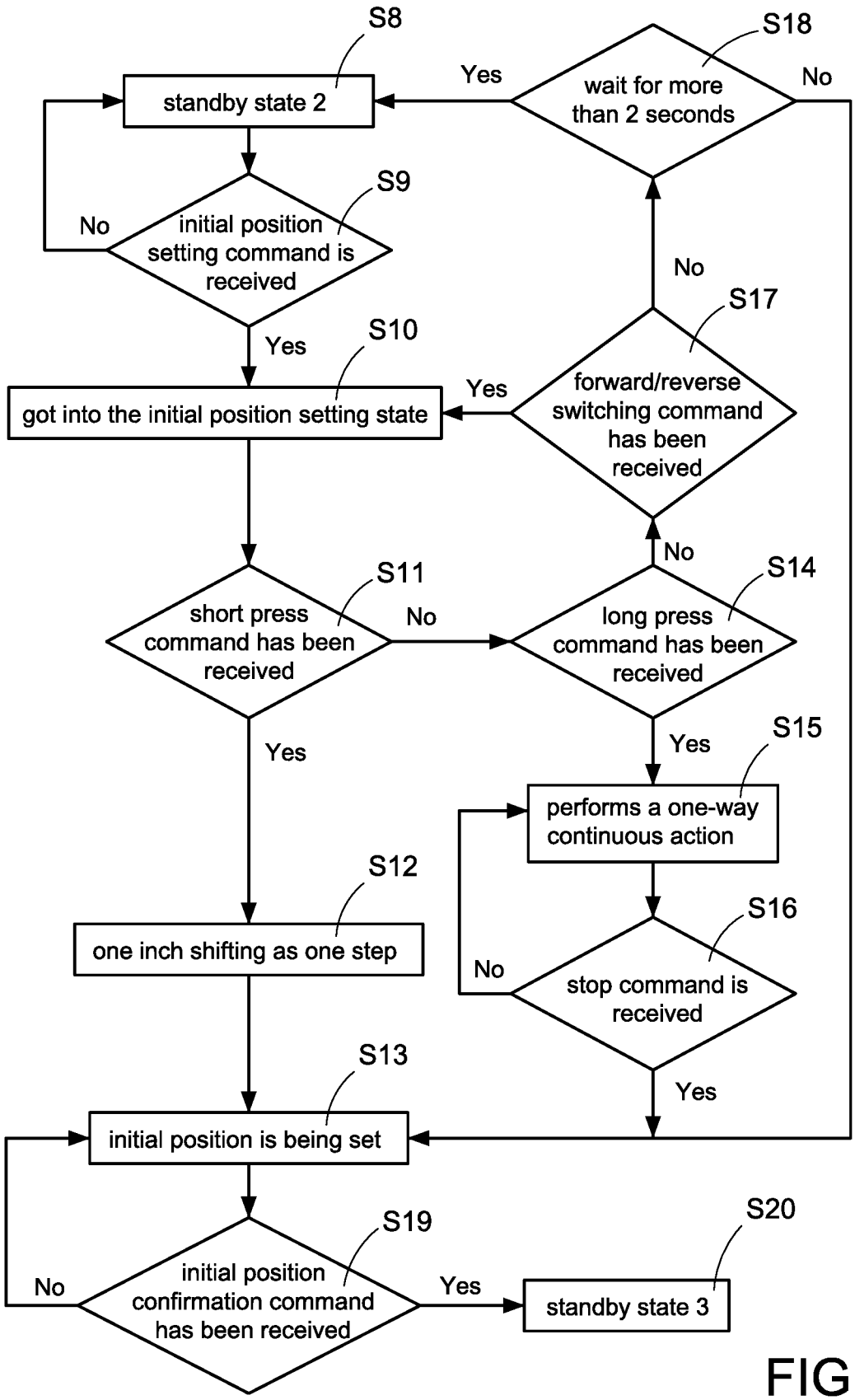

As shown in FIG. 9, after got into the standby state 2 (step S8), when the control circuit 121 determines that the initial position setting command is received (step S9), the first driving module 20 and the second driving module 30 got into the initial position setting state (step S10). During the initial position setting state, the first driving module 20 moves the middle rail 50 interposed between the first shielding curtain 100 and the second shielding curtain 200 to a first initial position according to the short press command or the long press command. The first initial position with a first initial height away from the ground. The second driving module 30 moves the lower rail 60 fixed to the bottom of the second shielding curtain 200 to a second initial position according to the short press command or the long press command. The second initial position with a second initial height away from the ground. Further, when it is confirmed that the short press command has been received (step S11), the middle rail 50 or the lower rail 60 stops after only one inch shifting as one step (may goes up or down) (step S12), and then the initial position is being set (step S13). If it is confirmed that the short press command has not been received, and then it is determined whether a long press command has been received (step S14). If it is confirmed that the long press command has been received, the middle rail 50 or the lower rail 60 performs a one-way continuous action (may goes up or down) (step S15) until a stop command is received (step S16), and then the initial position is being set (step S13). If it is confirmed that the long press command has not been received, and then it is determined whether a forward/reverse switching command has been received (step S17). If the forward/reverse switching command has been received, returning to the initial setting state (step S10). If the forward/reverse switching command has not been received, and then determined whether to wait for more than 2 seconds (step S18), if yes, returning to the standby state 2 (step S8); if not, and then the initial position is being set (step S13). Finally, if it is determined that an initial position confirmation command has been received (step S19), the initial position setting state is ended, and got into a standby state 3 (step S20). In the operation method of the present disclosure, the first initial position may be a position of the middle rail 50 when the first shielding curtain 100 is fully folded, and the second initial position may be a position of the lower rail 60 when the second shielding curtain 200 is fully folded. Further, when the control circuit 121 receives a restoration initial setting command, the first driving module 20 controls the middle rail 50 to move to the first initial position, and the second driving module 30 moves the lower rail 60 to the second initial position.

Figure 10:
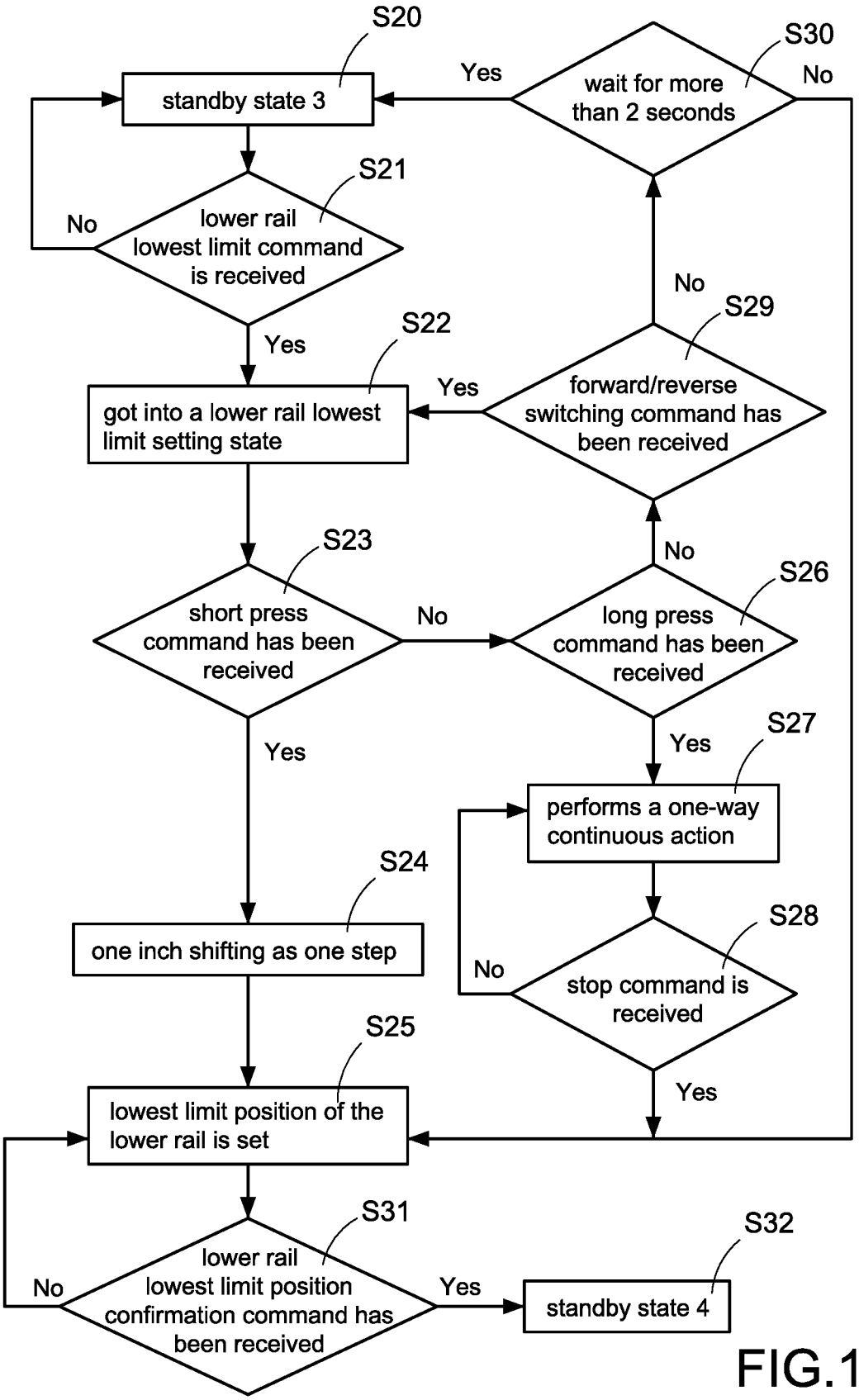

As shown in FIG. 10, after ending the initial position setting state and got into the standby state 3 (step S20), when the control circuit 121 determines that a lower rail lowest limit command is received (step S21), the second driving module 30 got into a lower rail lowest limit setting state (step S22). During the lower rail lowest limit setting state, the second driving module 30 moves the lower rail 60 to a lowest limit position of the lower rail according to the short press command or the long press command, and the lowest limit position of the lower rail with a first minimum height from the ground. Further, when it is confirmed that the short press command has been received (step S23), the lower rail 60 stops after only one inch shifting as one step (step S24), and then a lowest limit position of the lower rail 60 is set (step S25). If it is confirmed that the short press command has not been received, and then it is determined whether a long press command has been received (step S26). If it is confirmed that the long press command has been received, the lower rail 60 performs a one-way continuous action (may goes up or down) (step S27) until the stop command is received (step S28), and then the lowest limit position of the lower rail 60 is set (step S25). If it is confirmed that the long press command has not been received, it is then determined whether the forward/reverse switching command has been received (step S29). If it is confirmed that the forward/reverse switching command is received, returning to the lower rail lowest limit setting state (step S22). If it is confirmed that the forward/reverse switching command has not been received, and then it is determined whether to wait for more than 2 seconds (step S30), if yes, returning to the standby state 3 (step S20); if not, and then the lowest limit position of the lower rail 60 is set (step S25). Finally, if it is determined that a lower rail lowest limit position confirmation command has been received (step S31), the lower rail lowest limit setting state is ended and got into a standby state 4 (step S32).

Figure 11:
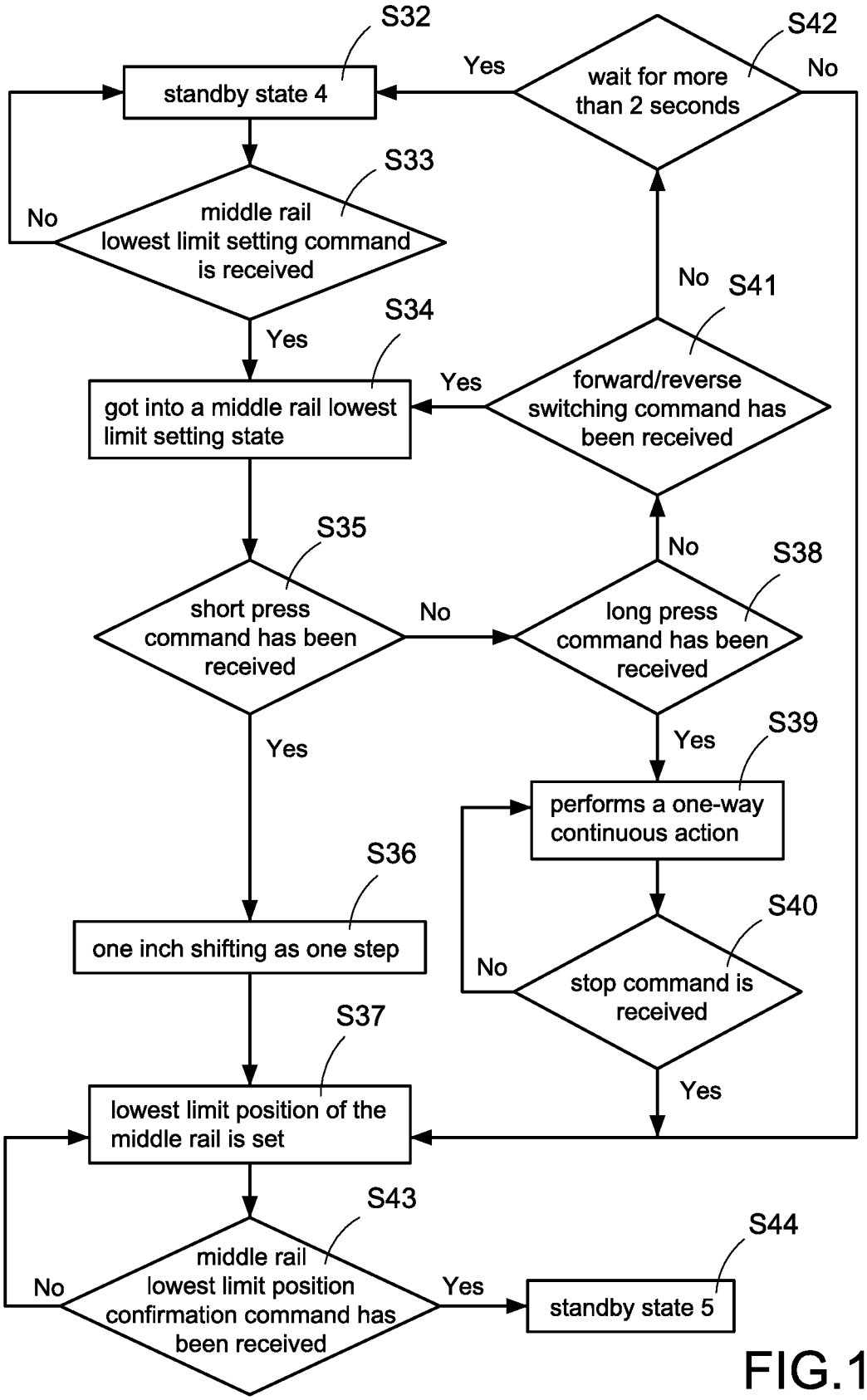

As shown in FIG. 11, after ending the lower rail lowest limit setting state and got into the standby state 4 (step S32), when the control circuit 121 determines that a middle rail lowest limit setting command is received (step S33), the first driving module 20 got into a middle rail lowest limit setting state (step S34). During the middle rail lowest limit setting state, the first driving module 20 moves the middle rail 50 to a lowest limit position of the middle rail according to the short press command or the long press command, and the lowest limit position of the middle rail with a second minimum height from the ground. Further, when it is confirmed that the short press command has been received (step S35), the middle rail 50 stops after only one inch shifting as one step (step S36), and then a lowest limit position of the middle rail 50 is set (step S37). If it is confirmed that the short press command has not been received, and then it is determined whether a long press command has been received (step S38). If it is confirmed that the long press command has been received, the middle rail 50 performs a one-way continuous action (may goes down) (step S39) until the stop command is received (step S40), and then the lowest limit position of the middle rail 50 is set (step S37). If it is confirmed that the long press command has not been received, it is then determined whether the forward/reverse switching command has been received (step S41). If it is confirmed that the forward/reverse switching command is received, returning to the middle rail lowest limit setting state (step S22). If it is confirmed that the forward/reverse switching command has not been received, and then it is determined whether to wait for more than 2 seconds (step S42), if yes, returning to the standby state 4 (step S32); if not, and then the lowest limit position of the middle rail 50 is set (step S37). Finally, if it is determined that a middle rail lowest limit position confirmation command has been received (step S43), the middle rail lowest limit setting state is ended and got into a standby state 5 (step S44).

In the operation method of the present disclosure, after confirming the end of the lower rail lowest limit setting state and the end of the middle rail lowest limit setting state, the lower rail 60 and the middle rail 50 can sequentially move in the same or opposite direction. The lower rail 60 and the middle rail 50 can sequentially move in same direction goes up or down. The lower rail 60 and the middle rail 50 can simultaneously move in the same or opposite direction. Further, the upper rail 70 can be fixed on the upper side of the door or window of a building or vehicle by a plurality of locking members 500 (as shown in FIG. 2). After confirming the end of the lower rail lowest limit setting state and the end of the middle rail lowest limit setting state, the lower rail 60 and the middle rail 50 got into a first state, a second state, a third state, a fourth state, a fifth state, a sixth state, a seventh state or an eighth state. The first state is that the middle rail 50 goes down and the lower rail 60 goes down in order. The second state is that the middle rail 50 goes up and the lower rail 60 goes up in order. The third state is that the middle rail 50 goes down and the lower rail 60 goes up in order. The fourth state is that the middle rail 50 goes up and the lower rail 60 goes down in order. The fifth state is that the middle rail 50 goes down and the lower rail 60 goes down simultaneously. The sixth state is that the middle rail 50 goes up and the lower rail 60 goes up simultaneously. The seventh state is that the middle rail 50 goes down and the lower rail 60 goes up simultaneously. The eighth state is that the middle rail 50 goes up and the lower rail 60 goes down simultaneously.

Figure 12:
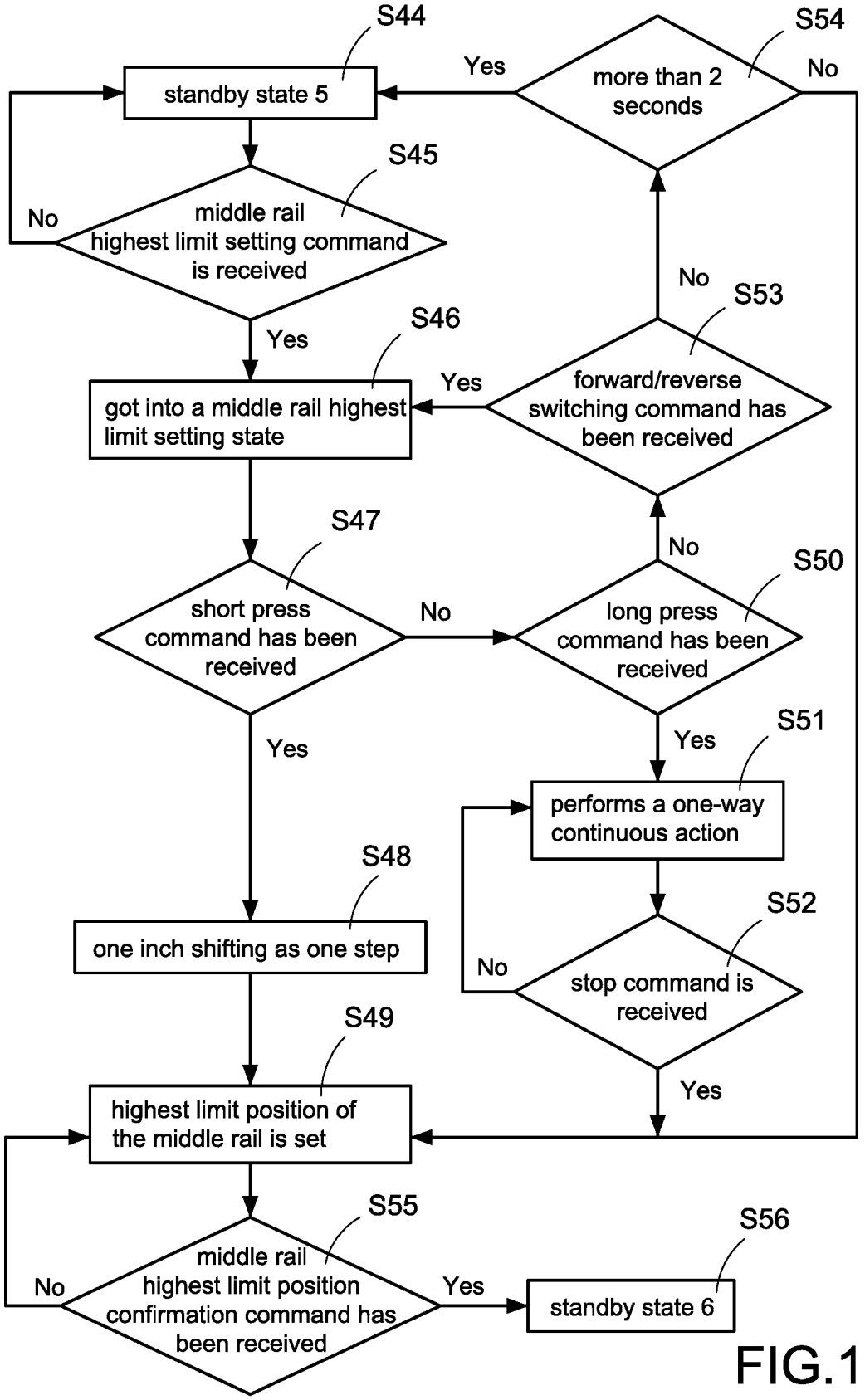

As shown in FIG. 12, after ending the middle rail lowest limit setting state and got into the standby state 5 (step S44), when the control circuit 121 determines that a middle rail highest limit setting command is received (step S45), the first driving module 20 got into a middle rail highest limit setting state (step S46). During the middle rail highest limit setting state, the first driving module 20 moves the middle rail 50 to a highest limit position of the middle rail according to the short press command or the long press command, and the highest limit position of the middle rail with a first maximum height from the ground. Further, when it is confirmed that the short press command has been received (step S47), the middle rail 50 stops after only one inch shifting as one step (step S48), and then a highest limit position of the middle rail 50 is set (step S49). If it is confirmed that the short press command has not been received, and then it is determined whether a long press command has been received (step S50). If it is confirmed that the long press command has been received, the middle rail 50 performs a one-way continuous action (may goes up) (step S51) until the stop command is received (step S52), and then the highest limit position of the middle rail 50 is set (step S49). If it is confirmed that the long press command has not been received, it is then determined whether the forward/reverse switching command has been received (step S53). If it is confirmed that the forward/reverse switching command is received, returning to the middle rail highest limit setting state (step S46). If it is confirmed that the forward/reverse switching command has not been received, and then it is determined whether to wait for more than 2 seconds (step S54), if yes, returning to the standby state 5 (step S44); if not, and then the highest limit position of the middle rail 50 is set (step S49). Finally, if it is determined that a middle rail highest limit position confirmation command has been received (step S55), the middle rail highest limit setting state is ended and got into a standby state 6 (step S56).

Figure 13:
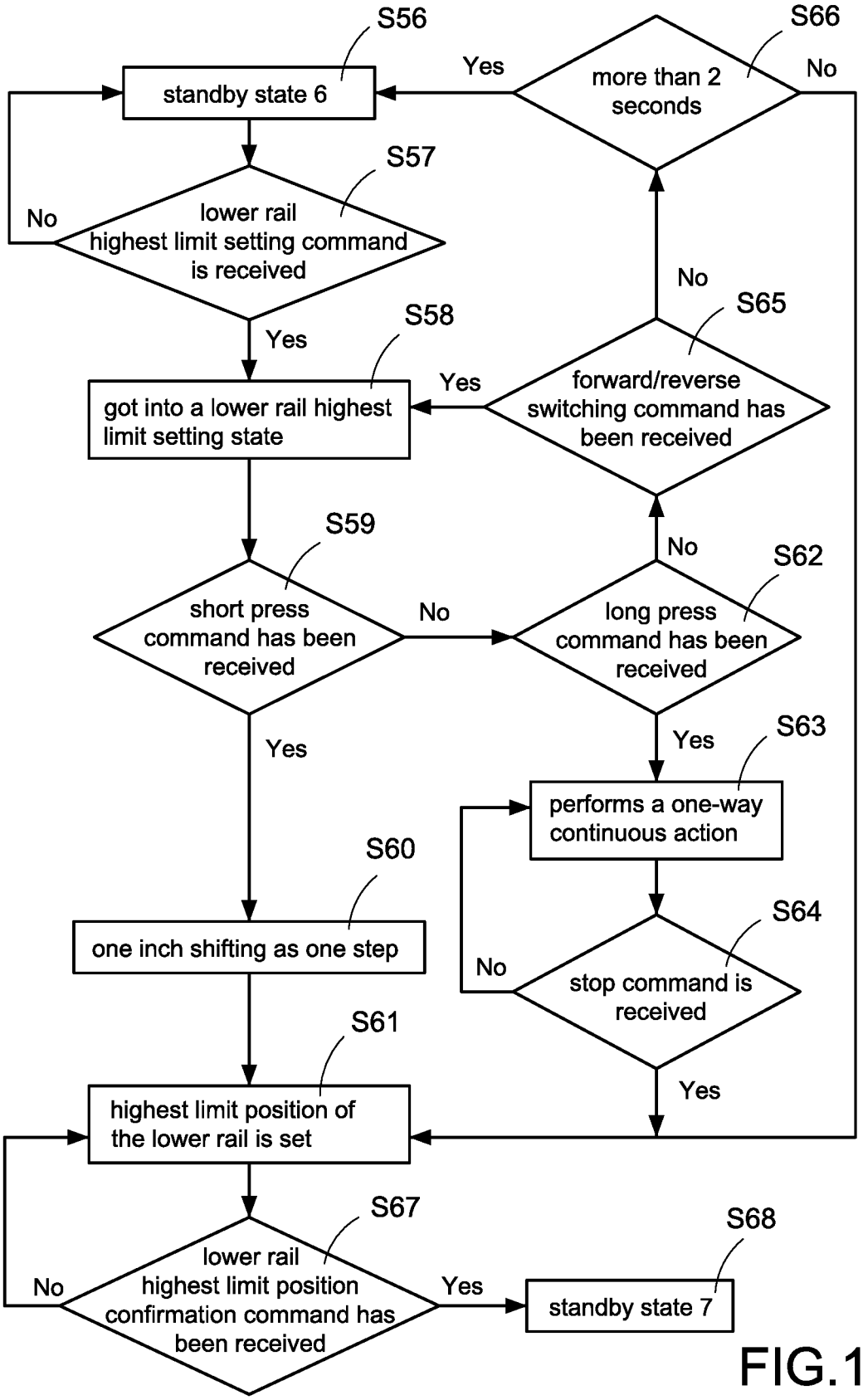

As shown in FIG. 13, after ending the middle rail highest limit setting state and got into the standby state 6 (step S56), when the control circuit 121 determines that a lower rail highest limit setting command is received (step S57), the second driving module 30 got into a lower rail highest limit setting state (step S58). During the lower rail highest limit setting state, the second driving module 30 moves the lower rail 60 to a highest limit position of the lower rail according to the short press command or the long press command, and the highest limit position of the lower rail with a second maximum height from the ground. Further, when it is confirmed that the short press command has been received (step S59), the lower rail 60 stops after only one inch shifting as one step (step S60), and then a highest limit position of the lower rail 60 is set (step S61). If it is confirmed that the short press command has not been received, and then it is determined whether a long press command has been received (step S62). If it is confirmed that the long press command has been received, the lower rail 60 performs a one-way continuous action (may goes up) (step S63) until the stop command is received (step S64), and then the highest limit position of the lower rail 60 is set (step S61). If it is confirmed that the long press command has not been received, it is then determined whether the forward/reverse switching command has been received (step S65). If it is confirmed that the forward/reverse switching command is received, returning to the lower rail highest limit setting state (step S58). If it is confirmed that the forward/reverse switching command has not been received, and then it is determined whether to wait for more than 2 seconds (step S66), if yes, returning to the standby state 6 (step S56); if not, and then the highest limit position of the lower rail 60 is set (step S61). Finally, if it is determined that a lower rail highest limit position confirmation command has been received (step S67), the lower rail highest limit setting state is ended and got into a standby state 7 (step S68).

Figure 14:
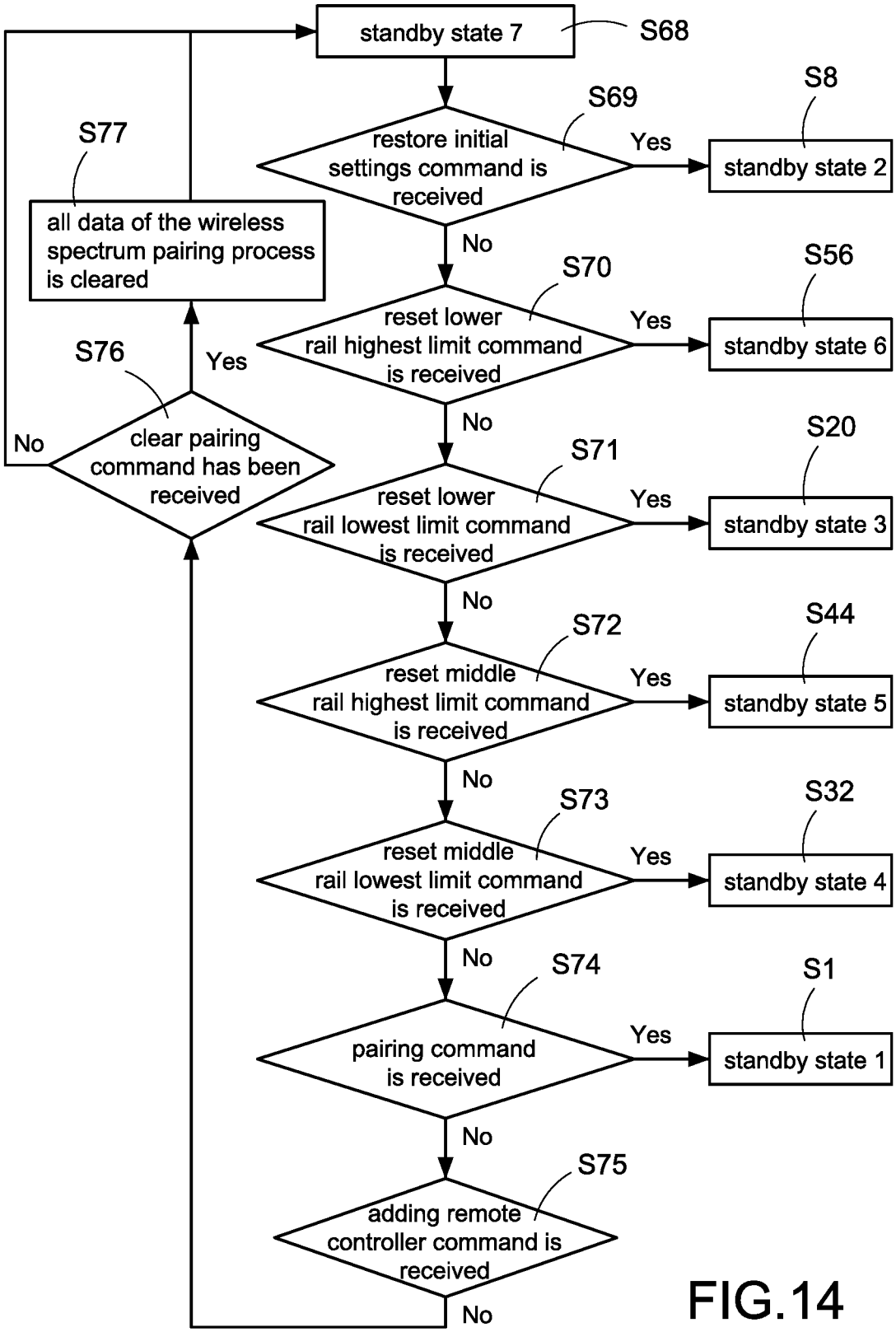

As shown in FIG. 14, after ending the lower rail highest limit setting state and got into the standby state 7 (step S68), the control circuit 121 sequentially determines as follows: Determining whether a restore initial settings command is received (step S69). Determining whether a reset lower rail highest limit command is received (step S70). Determining whether a reset lower rail lowest limit command is received (step S71). Determining whether a reset middle rail highest limit command is received (step S72). Determining whether a reset middle rail lowest limit command is received (step S73). Determining whether the pairing command is received (step S74). Determining whether the adding remote controller command is received (step S75). If it is confirmed that the restore initial settings command is received, returning to the standby state 2 (step S8). If it is confirmed that the reset lower rail highest limit command is received, returning to the standby state 6 (step S56). If it is confirmed that the reset lower rail lowest limit command is received, returning to the standby state 3 (step S20). If it is confirmed that the reset middle rail highest limit command is received, returning to the standby state 5 (step S44). If it is confirmed that the reset middle rail lowest limit command is received, returning to the standby state 4 (step S32). If it is confirmed that the pairing command is received, returning to the standby state 1 (step S1). If it is confirmed that the adding remote controller command is received, returning to the standby state 1 (step S1). Further, if it is confirmed that the adding remote controller command has not been received (step S75), and it is confirmed that the clear pairing command has been received (step S76), all data of the wireless spectrum pairing process is cleared (step S77), and then return to standby state 7 (step S68). If it is confirmed that the clear pairing command has not been received (step S76), it directly returns to the standby state 7 (step S68).

Figure 15:
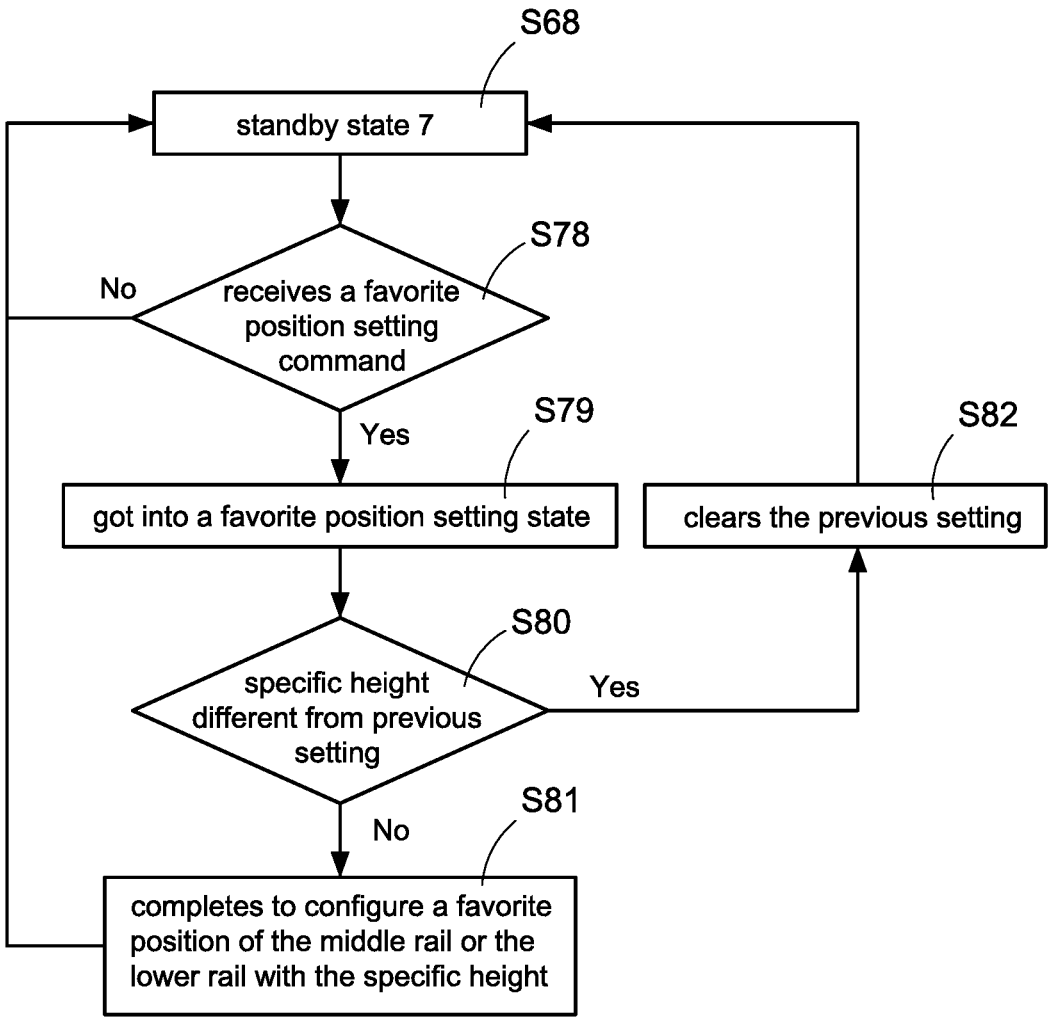

As shown in FIG. 15, in the standby state 7 (step S68), when the control circuit 121 receives a favorite position setting command to move the middle rail 50 or the lower rail 60 to a specific height (step S78), the first driving module 20 or the second driving module 30 got into a favorite position setting state (step S79). During the favorite position setting state, if the control circuit 121 determines that the specific height different from previous setting (step S80), the control circuit 121 completes to configure a favorite position of the middle rail 50 or the lower rail 60 with the specific height (step S81), and ended the favorite position setting state (step S68). If the control circuit 121 determines that the specific height as same as the previous setting (step S80), the control circuit 121 clears the previous setting (step S82), and end the favorite position setting state and returning to the standby state 7 (step S68).

Figure 16:
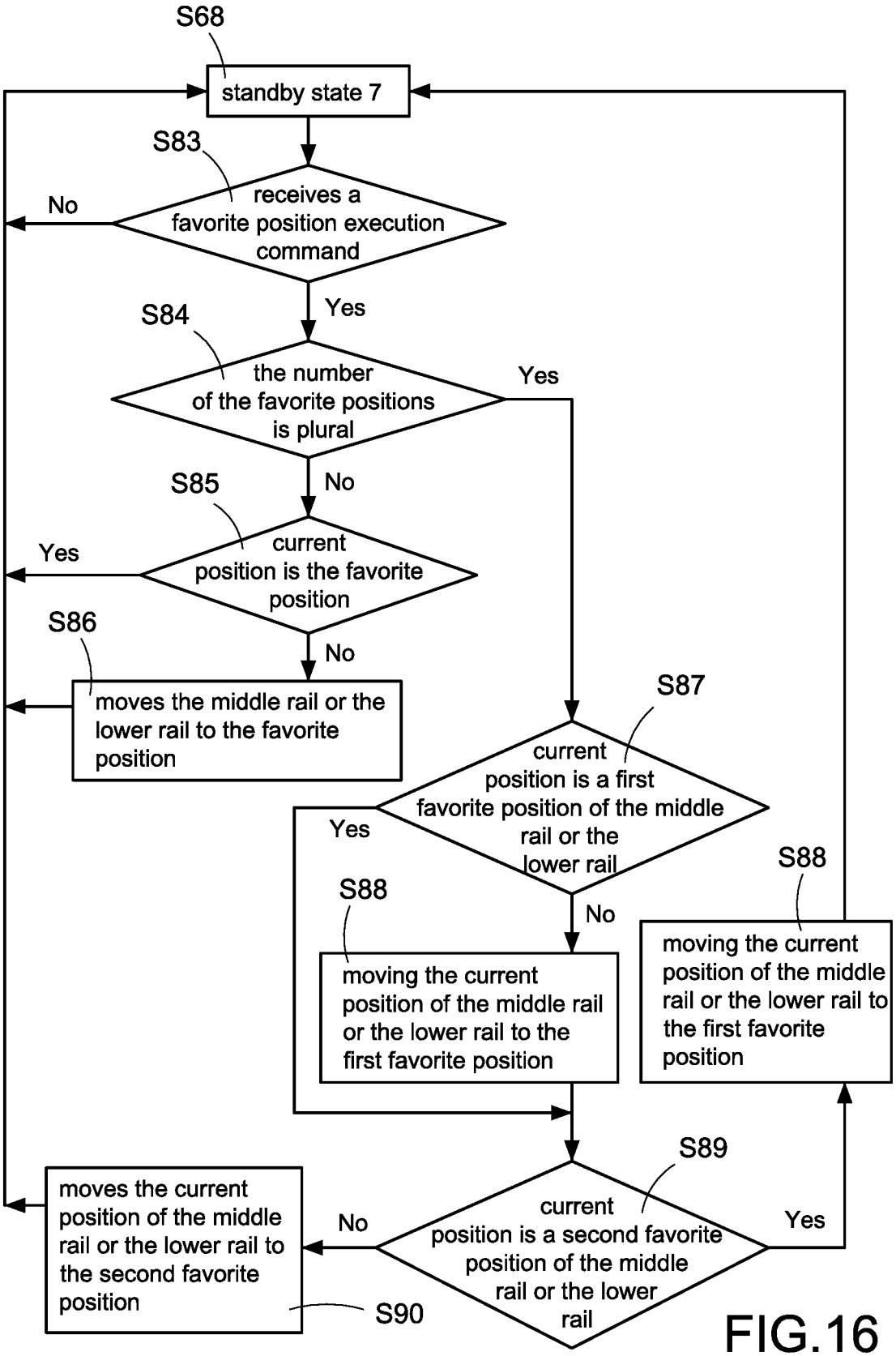

As shown in FIG. 16, after completing the aforementioned configuration, the rail 50 or the lower rail 60 has a favorite position with the specific height (step S81), and after the favorite position setting state is completed and returning to the standby state 7 (step S68), the following steps may be further included: If the middle rail 50 or the lower rail 60 close to the favorite position, when the control circuit 121 receives a favorite position execution command (step S83), and there is only one the favorite location (step S84) and the current position is not the favorite position (step S85), the control circuit 121 moves the middle rail 50 or the lower rail 60 to the favorite position (step S86). If there is only one the favorite location (step S84) and the current position is the favorite position (step S85), the control circuit 121 stops the middle rail 50 and the lower rail 60, and returns to the standby state 7 (step S68). Further, if the number of the favorite positions is plural (step S84), the control circuit 121 determines whether the current position is a first favorite position of the middle rail 50 or the lower rail 60 when receiving the favorite position execution command (step S87). If not, moving the current position of the middle rail 50 or the lower rail 60 to the first favorite position (step S88), and return to the standby state 7 (step S68). If yes, continue to determine whether the current position is a second favorite position of the middle rail 50 or the lower rail 60 (step S89). When it is determined that the current position is not the second favorite position of the middle rail 50 or the lower rail 60 (step S89), the control circuit 121 moves the current position of the middle rail 50 or the lower rail 60 to the second favorite position (step S90), and return to the standby state 7 (step S68). When it is determined that the current position is the second favorite position of the middle rail 50 or the lower rail 60 (step S89), the control circuit 121 moves the middle rail 50 and the lower rail 60 to the first favorite point position, and return to the standby state 7 (step S68).

When using the solar adjustment device according to the present disclosure, because of the first shielding curtain 100 and the second shielding curtain 200 are arranged parallel to each other, the thickness of the first shielding curtain 100 and the second shielding curtain 200 will not increase cause by the first shielding curtain 100 and the second shielding curtain 200 overlap each other. Further, the first shielding curtain 100 has the plurality of the first air chambers 101 foldable, the second shielding curtain 200 has the plurality of the second air chambers 201 foldable. Therefore, the shielding areas of the first shielding curtain 100 and the second shielding curtain 200 respectively on buildings or vehicles can be changed by extending and collapsing their foldable air chambers. The air chamber can save the material consumption of the first shielding curtain 100 and the second shielding curtain 200, and reduce the weight of the overall apparatus. In addition, the air chambers also have a good heat insulation effect when it is extended (air is not a good conduction medium for heat energy), which can save the cost of indoor air conditioning. In addition, when using the solar adjustment apparatus of the present disclosure, the middle rail 50 or the lower rail 60 can be preset with the initial position, the highest limit position, and the lowest limit position. So that the middle rail 50 and the lower rail 60 are electrically controlled by the first driving module 20 and the second driving module 30 within a safe range. The first driving module 20 and the second driving module 30 can precisely control the middle rail 50 and the lower rail 60 to reach a precise position by the control of the first optical encoder 300 and the second optical encoder 400. Further, because of the speed of the middle rail 50 moved by the first driving module 20 is equal to the speed of the lower rail 60 moved by the second driving module 30, it can avoid the collision between the middle rail 50 and the lower rail 60 when they move in the same or opposite direction, and simultaneously or sequentially. It can avoid problems such as twisting or distortion of curtains. Further, the control circuit 121 can determine the relative position and distance of the middle rail 50 and the lower rail 60 according to the inner perforations A and the outer perforations B on the light shielding discs 301, 401. For example, the control circuit 121 can control the relative distance between the middle rail 50 and the lower rail 60 to be equal to or less than the circumferential distance corresponding to the three inner perforations A or the three outer perforations B. This is only an exemplary description, and the present disclosure is not limited thereto. The control circuit 121 can further control the first driving module 20 or the second driving module 30 to decelerate or stop, so that the relative distance between the middle rail 50 and the lower rail 60 can be accurately controlled by the control circuit 121, the first optical encoder 300, and the second optical encoder 400. For this reason, it can avoid the collision between the middle rail 50 and the lower rail 60 when they move in the same or opposite direction, and simultaneously or sequentially.

For this reason, solar adjustment apparatus that can solve the technical problems of difficult to follow relative position of the sun and the earth to make accurate adjustments for light, and can avoid the problems such as components of multiple curtains easily collide with each other, entangle with each other, or deform and twist. Therefore, the curtains can be accurately controlled, and the life and durability can be improved, to achieve the purpose of easy to operate and maintain for users.

The above is only a detailed description and drawings of the preferred embodiments of the present disclosure, but the features of the present disclosure are not limited thereto, and are not intended to limit the present disclosure. All the scope of the present disclosure shall be subject to the scope of the following claims. The embodiments of the spirit of the present disclosure and its similar variations are intended to be included in the scope of the present disclosure. Any variation or modification that can be easily conceived by those skilled in the art in the field of the present disclosure can be covered by the following claims.

What is claimed is:

1. A method of operating a solar adjustment apparatus, an upper rail of the solar adjustment apparatus fixed on an upper side of a door or window of a building or vehicle, a middle rail and a lower rail sequentially arranged below the upper rail and movable in a vertical direction: the middle rail controlled by a first driving module, the lower rail controlled by a second driving module, and a control circuit configured to control the first driving module and the second driving module, the operating method comprising steps of:

a remote controller transferring an initial position setting command to the control circuit, when the control circuit receiving the initial position setting command, the first driving module and the second driving module getting into an initial position setting state, during the initial position setting state, the first driving module moving the middle rail according to a short press command or a long press command, the control circuit controlling an output of the first driving module to match the initial position setting command by a first optical encoder, and the first driving module moving the middle rail to a first initial position, the first initial position with a first initial height away from the ground, and the second driving module moving the lower rail according to the short press command or the long press command, the control circuit controlling an output of the second driving module to match the initial position setting command by a second optical encoder, and the second driving module moving the lower rail to a second initial position, the second initial position with a second initial height away from the ground, after confirming the end of the initial position setting state, the remote controller transferring a lower rail lowest limit command to the control circuit, when the control circuit receiving the lower rail lowest limit command, the second driving module getting into a lower rail lowest limit setting state, during the lower rail lowest limit setting state, the second driving module moving the lower rail according to the short press command or the long press command, the control circuit controlling the output of the second driving module to match the lower rail lowest limit command by the second optical encoder, and the second driving module moving the lower rail to a lowest limit position of the lower rail, and the lowest limit position of the lower rail with a first minimum height from the ground, after confirming the end of the initial position setting state, the remote controller transferring a middle rail lowest limit command to the control circuit, when the control circuit receiving the middle rail lowest limit command, the first driving module getting into a middle rail lowest limit setting state, during the middle rail lowest limit setting state, the first driving module moving the middle rail according to the short press command or the long press command, the control circuit controlling the output of the first driving module to match the middle rail lowest limit command by the first optical encoder, and the first driving module moving the middle rail to a lowest limit position of the middle rail, and the lowest limit position of the middle rail with a second minimum height from the ground, after confirming the end of the initial position setting state, the remote controller transferring a middle rail highest limit command to the control circuit, when the control circuit receiving the middle rail highest limit command, the first driving module getting into a middle rail highest limit setting state, during the middle rail highest limit setting state, the first driving module moving the middle rail according to the short press command or the long press command, the control circuit controlling the output of the first driving module to match the middle rail highest limit command by the first optical encoder, and the first driving module moving the middle rail to a highest limit position of the middle rail, and the highest limit position of the middle rail with a first maximum height from the ground, and after confirming the end of the initial position setting state, the remote controller transferring a lower rail highest limit command to the control circuit, when the control circuit receiving the lower rail highest limit command, the second driving module getting into a lower rail highest limit setting state, during the lower rail highest limit setting state, the second driving module moving the lower rail according to the short press command or the long press command, the control circuit controlling the output of the second driving module to match the lower rail highest limit command by the second optical encoder, and the second driving module moving the lower rail to a highest limit position of the lower rail, and the highest limit position of the lower rail with a second maximum height from the ground, wherein, a speed of the middle rail moved by the first driving module is equal to a speed of the lower rail moved by the second driving module, the middle rail is moved between the highest limit position of the middle rail and the lowest limit position of the middle rail, the lower rail is moved between the highest limit position of the lower rail and the lowest limit position of the lower rail;

further comprising: providing a first Hall sensor, a first brushless DC motor, and a first deceleration box in the first driving module; the first Hall sensor coupled to the control circuit and the first brushless DC motor, the first brushless DC motor pivotally coupled to the first deceleration box and the first optical encoder;

further comprising: providing a second Hall sensor, a second brushless DC motor, and a second deceleration box in the second driving module; the second Hall sensor coupled to the control circuit and the second brushless DC motor, the second brushless DC motor pivotally coupled to the second deceleration box and the second optical encoder;

further comprising: providing a first light shielding disc in the first optical encoder, the first light shielding disc comprises first inner perforations with equal intervals in a first circle, and there are first outer perforations surrounding outside of the first inner perforations;

further comprising: providing a second light shielding disc in the second optical encoder, the second light shielding disc comprises second inner perforations with equal intervals in a second circle, and there are second outer perforations surrounding outside of the second inner perforations;

wherein, the first driving module and the second driving module have the same speed to prevent a collision between the middle rail and the lower rail.

2. The method of operating the solar adjustment apparatus in claim 1, wherein the middle rail or the lower rail is stopped after only one inch shifting according to the short press command, or the middle rail or the lower rail performs a one-way continuous action according to the long press command until the control circuit receives a stop command.

3. The method of operating the solar adjustment apparatus in claim 1, further comprising: providing a wireless port in the solar adjustment apparatus and coupled to the control circuit, wherein the remote controller inputs the initial position setting command, the lower rail lowest limit command, the middle rail lowest limit command, the middle rail highest limit command, or the lower rail highest limit command to the control circuit through the wireless port.

4. The method of operating the solar adjustment apparatus in claim 1, wherein after confirming the end of the lower rail lowest limit setting state and the end of the middle rail lowest limit setting state, the lower rail and the middle rail entering into a first state, a second state, a third state, a fourth state, a fifth state, a sixth state, a seventh state or an eighth state, the first state is that the middle rail goes down and the lower rail goes down in order, the second state is that the middle rail goes up and the lower rail goes up in order, the third state is that the middle rail goes down and the lower rail goes up in order, the fourth state is that the middle rail goes up and the lower rail goes down in order, the fifth state is that the middle rail goes down and the lower rail goes down simultaneously, the sixth state is that the middle rail goes up and the lower rail goes up simultaneously, the seventh state is that the middle rail goes down and the lower rail goes up simultaneously, the eighth state is that the middle rail goes up and the lower rail goes down simultaneously.

5. The method of operating the solar adjustment apparatus in claim 1, wherein the first driving module controls the middle rail by the first optical encoder and one of spools, the second driving module control the lower rail by the second optical encoder and another one of the spools.

6. The method of operating the solar adjustment apparatus in claim 1, further comprising step of:

the remote controller transferring a restore initial setting command to the control circuit, wherein when the control circuit receives the restore initial setting command, the first driving module move the middle rail to the first initial position, the second driving module moves the lower rail to the second initial position.

7. The method of operating the solar adjustment apparatus in claim 1, further comprising: arranging a first shielding curtain between the upper rail and the middle rail, wherein the first driving module is controls the middle rail through a first spool of a spool box and a first lifting rope wound on the first spool, the first lifting rope is movably inserted in the first shielding curtain, and connected to the middle rail.

8. The method of operating the solar adjustment apparatus in claim 7, further comprising: arranging a second shielding curtain between the middle rail and the lower rail, wherein the second driving module controls the lower rail through a second spool of the spool box and a second lifting rope wound on the second spool, the second lifting rope is movably inserted in the first shielding curtain and the second shielding curtain, and connected to the lower rail.

9. The method of operating the solar adjustment apparatus in claim 1, further comprising step of:

the remote controller transferring a pairing command to the control circuit, wherein when the control circuit receives the pairing command, the control circuit performs a wireless spectrum pairing process with a remote controller according to the pairing command within a specific time.

10. The method of operating the solar adjustment apparatus in claim 9, further comprising step of:

the remote controller transferring an adding remote controller command to the control circuit, wherein when the control circuit receives the adding remote controller command, the control circuit performs the wireless spectrum pairing process with another remote controller according to the adding remote controller command within the specific time.

11. The method of operating the solar adjustment apparatus in claim 9, further comprising step of:

the remote controller transferring a clear pairing command to the control circuit, wherein when the control circuit receives the clear pairing command, the control circuit clears all data of the wireless spectrum pairing process.

12. The method of operating the solar adjustment apparatus in claim 1, further comprising step of:

the remote controller transferrin a favorite position setting command to the control circuit, wherein when the control circuit receives the favorite position setting command to move the middle rail or the lower rail to a specific height, the first driving module or the second driving module gets into a favorite position setting state, during the favorite position setting state, if the control circuit to determines that the specific height is different from previous setting, the control circuit completes to configure a favorite position of the middle rail or the lower rail with the specific height, and ends the favorite position setting state, or if the control circuit determines that the specific height is same as the previous setting, the control circuit clears the previous setting, and ends the favorite position setting state.

13. The method of operating the solar adjustment apparatus in claim 12, further comprising steps of:

if the middle rail or the lower rail being close to the favorite position, the remote controller transferrin a favorite position execution command to the control circuit, wherein when the control circuit receives the favorite position execution command, the control circuit moves the middle rail or the lower rail to the favorite position, if the middle rail or the lower rail being already in the favorite position, and a plurality of the favorite locations being present, the remote controller transferring the favorite position execution command to the control circuit, wherein when the control circuit receives the favorite position execution command, the control circuit moves the middle rail or the lower rail to another one of the plurality of the favorite locations, and if the middle rail or the lower rail being already in the favorite position, and only one the favorite location being present, the remote controller transferring the favorite position execution command to the control circuit, wherein when the control circuit receives the favorite position execution command, the control circuit configuring the middle rail or the lower rail to remain still.

* * * * *